US009583861B2

(12) United States Patent
Harada

(10) Patent No.: US 9,583,861 B2
(45) Date of Patent: Feb. 28, 2017

(54) ELECTRONIC DEVICE AND CONNECTOR SECTION

(71) Applicant: CASIO COMPUTER CO., LTD., Shibuya-ku, Tokyo (JP)

(72) Inventor: Eiichi Harada, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/747,720

(22) Filed: Jun. 23, 2015

(65) Prior Publication Data

US 2015/0380855 A1 Dec. 31, 2015

(30) Foreign Application Priority Data

Jun. 30, 2014 (JP) ..... 2014-133626

(51) Int. Cl.

| | |
|---|---|
| ***H01R 27/00*** | (2006.01) |
| ***H01R 13/44*** | (2006.01) |
| ***H01R 13/66*** | (2006.01) |
| ***H01R 24/62*** | (2011.01) |
| *H01R 107/00* | (2006.01) |

(52) U.S. Cl.
CPC ..... *H01R 13/44* (2013.01); *H01R 13/665* (2013.01); *H01R 24/62* (2013.01); *H01R 27/00* (2013.01); *H01R 2107/00* (2013.01)

(58) Field of Classification Search
CPC ..... H01R 27/00; H01R 29/00; H01R 31/06
See application file for complete search history.

(56) References Cited

U.S. PATENT DOCUMENTS

| | | | | | |
|---|---|---|---|---|---|
| 2,538,296 | A * | 1/1951 | Crocker | H01R 27/00 | 439/131 |
| 2,624,776 | A * | 1/1953 | Price | H01R 33/94 | 439/172 |
| 4,911,649 | A * | 3/1990 | Helmich, Jr. | H01R 29/00 | 439/170 |
| 5,684,689 | A * | 11/1997 | Hahn | H01R 13/6675 | 363/146 |
| 5,848,907 | A * | 12/1998 | Chen | H01R 31/06 | 439/172 |
| 6,109,977 | A * | 8/2000 | Baxter | H01R 13/04 | 439/171 |

(Continued)

FOREIGN PATENT DOCUMENTS

| | | | |
|---|---|---|---|
| JP | 2000339067 | A | 12/2000 |
| JP | 2001251335 | A | 9/2001 |

*Primary Examiner* — Gary Paumen
(74) *Attorney, Agent, or Firm* — Holtz, Holtz & Volek PC

(57) ABSTRACT

An electronic device includes a device body having a installation section provided on the outer surface and an internal circuit provided therein, and a connector section which can be attached to the installation section and can be removed from the installation section. The connector section has at least one functional section for connection to an external device and a first terminal electrically connected to the functional section. The device body has a second terminal electrically connected to the internal circuit and exposed on the inner surface of the installation section. The second terminal is arranged at a position where the second terminal is connected to the first terminal when the connector section is attached to the installation section.

9 Claims, 13 Drawing Sheets

(56) References Cited

U.S. PATENT DOCUMENTS 6,544,058 B1 * 4/2003 Chang ..... H01R 31/06 439/173
6,699,052 B1 * 3/2004 Poran ..... H01R 13/6633 439/172
7,037,120 B1 * 5/2006 Yeh ..... H01R 24/62 439/131
7,264,492 B2 * 9/2007 Liang ..... H01R 13/22 439/151
7,300,297 B1 * 11/2007 Wang ..... H01R 13/2442 439/173
7,419,393 B2 * 9/2008 Milan ..... H01R 31/06 439/171
7,654,838 B1 * 2/2010 Zhuge ..... H01R 13/652 439/173
7,794,251 B2 * 9/2010 Wen ..... H01R 13/514 320/111
7,815,450 B1 * 10/2010 Chen ..... H01R 13/60 439/172
7,950,938 B1 * 5/2011 Teoh ..... H01R 31/06 439/171
7,970,973 B2 * 6/2011 Fang ..... G06F 13/4081 439/173
8,029,303 B2 * 10/2011 Chiang ..... H01R 13/60 439/131
8,267,705 B2 * 9/2012 Huang ..... H01R 27/00 439/171
8,382,526 B2 * 2/2013 Chen ..... H01R 13/639 439/173
8,460,016 B2 * 6/2013 Liu ..... H01R 13/6456 439/106
8,465,307 B2 * 6/2013 Shieh ..... H01R 31/06 439/173
8,979,563 B2 * 3/2015 Ofenloch ..... H01R 9/24 439/171
2005/0176281 A1 * 8/2005 Zhuge ..... H01R 13/6272 439/173
2006/0099840 A1 * 5/2006 Yeh ..... H01R 24/62 439/172
2007/0178735 A1 * 8/2007 Chen ..... H01R 24/62 439/172
2008/0064244 A1 * 3/2008 Holland ..... H01R 13/652 439/171
2014/0335709 A1 * 11/2014 Chung ..... H01R 31/06 439/172

* cited by examiner

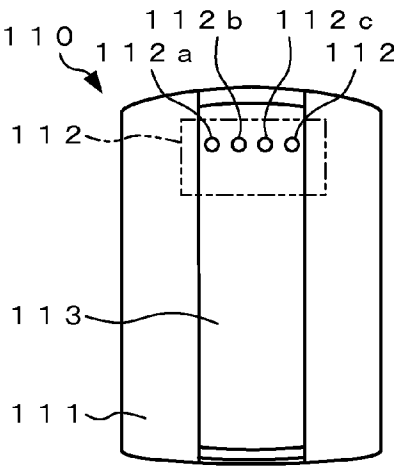
FIG. 2A
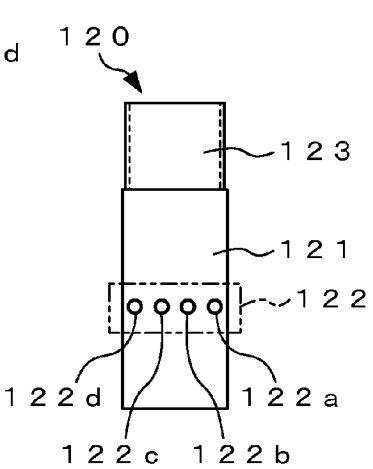
FIG. 2B
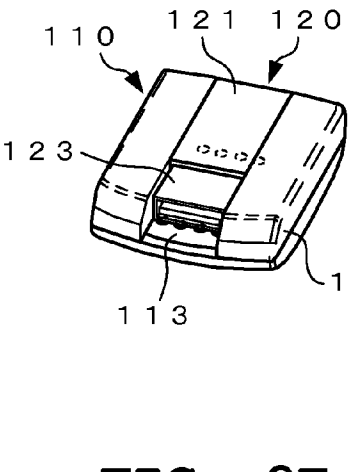
FIG. 2D
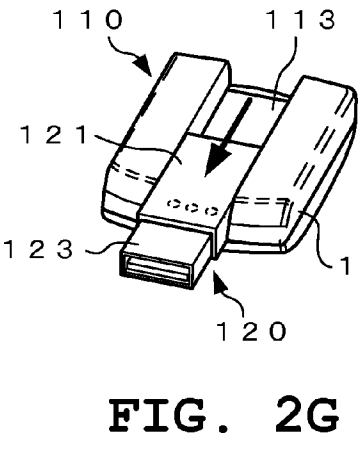
FIG. 2F
FIG. 2C
FIG. 2E
FIG. 2G 110
112a
112b
112c
112d
112e
112
113
111

120
123
121
122
122a
122b
122c
122d
122e 120
121
113
111
122
123
110
112

110
120
121
123
113
111

110
113
120
112
123
121
122
111

110
113
121
123
120
111

120
113
111
123
121
112
(122)

110
112
112a
112d
112f
112g
112i
112h
113
111

120
123
121
122
122a
122f
122g
122h
122i
122d 120
121
113
111
122
123
110
112

110
121
120
123
113
111

110
113
112
123
121
122
111
120

110
113
121
123
120
111

123
121
112
(122)
120
113
111

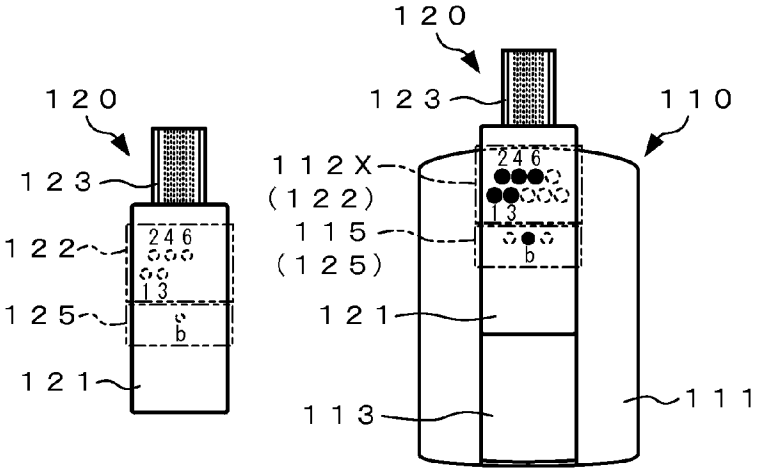
FIG. 9A
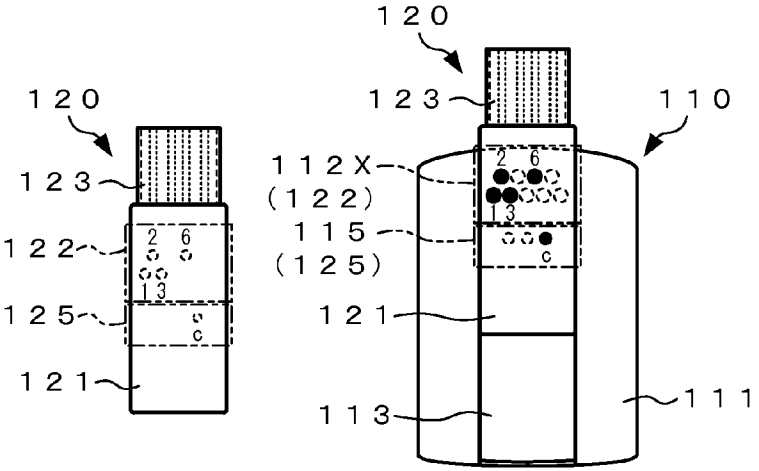
FIG. 9B
FIG. 9C
FIG. 9D
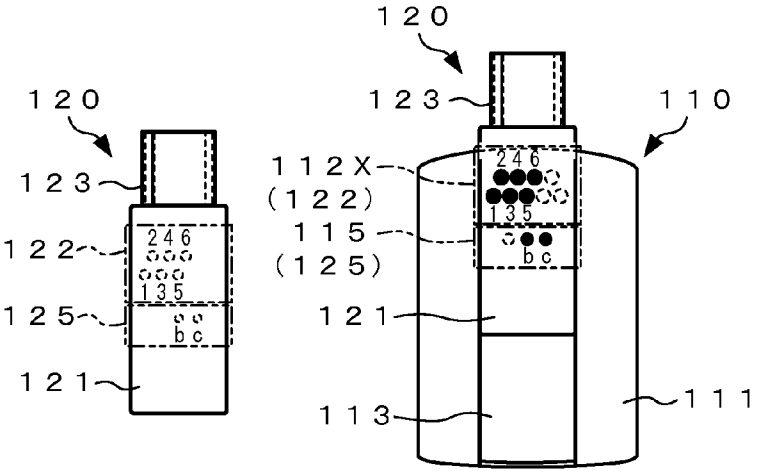
FIG. 9E
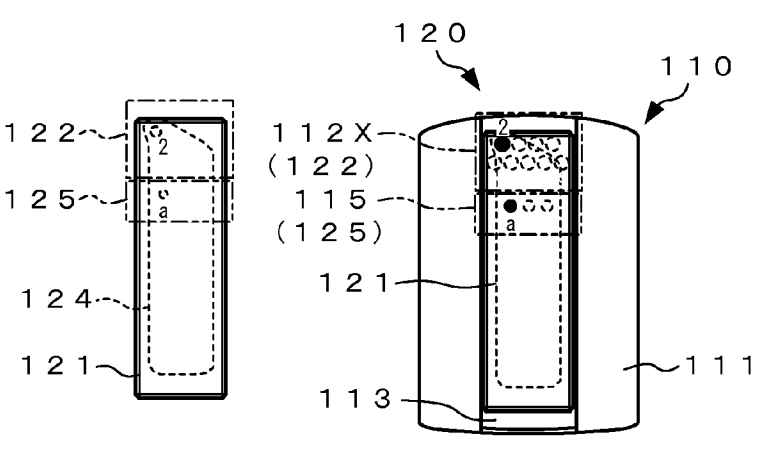
FIG. 9F
FIG. 9G
FIG. 9H XD-XD CROSS-SECTION
XIIA
XIIB
XD
110
111
112
112a
112b
112c
112d
113
117
117s
118
120
121
126
126a
126b
126c
126d
127
127s
128

DETAILS OF XIC PORTION

XIE-XIE CROSS-SECTION

XIIA-XIIA CROSS-SECTION

XIIB-XIIB CROSS-SECTION

XIIIDB-XIIIDB CROSS-SECTION
XIIIDA-XIIIDA CROSS-SECTION
XIIICB-XIIICB CROSS-SECTION
XIIICA-XIIICA CROSS-SECTION
XIIIDA
XIIIDB
XIIICA
XIIICB
110
111
112
113
120
121
126
127
128
129
210
211
212

ELECTRONIC DEVICE AND CONNECTOR SECTION

CROSS-REFERENCE TO RELATED APPLICATION

This application is based upon and claims the benefit of priority from the prior Japanese Patent Application No. 2014-133626, filed Jun. 30, 2014, the entire contents of which are incorporated herein by reference.

BACKGROUND OF THE INVENTION

1. Field of the Invention

The present invention relates to an electronic device having a mechanism to be connected to various external devices for the transmission and reception of data and power feeding.

2. Description of the Related Art

In recent years, with the widespread of personal computers (PC), smartphones, tablet terminals, and wearable terminals for collecting biological information and the like, various data and information have been transmitted and received between various electronic devices.

Also, with the widespread of portable (mobile) electronic devices, power feeding for charging a secondary battery (rechargeable battery) incorporated in a device has been frequently performed.

In the transmission and reception of data (hereinafter referred to as "data transmission") and power feeding between electronic devices, a known method using a wire cable or wireless communication is generally used. For example, Japanese Patent Application Laid-Open (Kokai) Publication No. 2000-339067 discloses a technique where a USB (Universal Serial Bus) cable is used for data transmission and power feeding between a PC and another electronic device. Also, Japanese Patent Application Laid-Open (Kokai) Publication No. 2001-251335 discloses a technique where data transmission is performed by using a wireless communication technology corresponding to communication standards such as Bluetooth (registered trademark).

However, in these disclosed methods, a communication cable is required to be kept available for data transmission and power feeding between electronic devices. In addition, an operation of connecting the electronic devices by the communication cable is required to be performed, which is burdensome for the device user.

In particular, because the shapes and the specifications of communication cables for use in data transmission and power feeding often vary according to their electronic device manufacturers, communication standards, and the like, users having a plurality of electronic devices may be required to keep a plurality of communication cables of different types available, and reconnect or switch them.

In addition, in cases where data transmission via wireless communication is performed between the electronic devices, functional sections for wireless communication are required to be incorporated into electronic devices in advance, which disadvantageously increase the sizes of the electronic devices, complicate the structures, and affect the production costs.

SUMMARY OF THE INVENTION

The present invention has an advantageous effect in that electronic devices can be provided which are appropriately connected to various external devices without a communication cable and appropriately perform data transmission and power feeding.

In accordance with one aspect of the present invention, there is provided an electronic device comprising: a device body which has an installation section provided on an outer surface and an internal circuit provided therein; and a connector section which can be attached to the installation section and can be removed from the installation section, wherein the connector section has at least one functional section for connection to an external device and at least one first terminal which is electrically connected to the functional section; and the device body has at least one second terminal which is electrically connected to the internal circuit, exposed on an inner surface of the installation section, and arranged at a position where the second terminal is electrically connected to the first terminal when the connector section is attached to the installation section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 2A to FIG. 2G are structural diagrams showing a first specific example of the electronic device according to the first embodiment;

FIG. 9A to FIG. 9H are schematic diagrams showing examples (first to fourth examples) of attached and sliding states of the connector section in the electronic device of the second specific example of the third embodiment;

DETAILED DESCRIPTION OF THE PREFERRED EMBODIMENTS

Figure 1A:
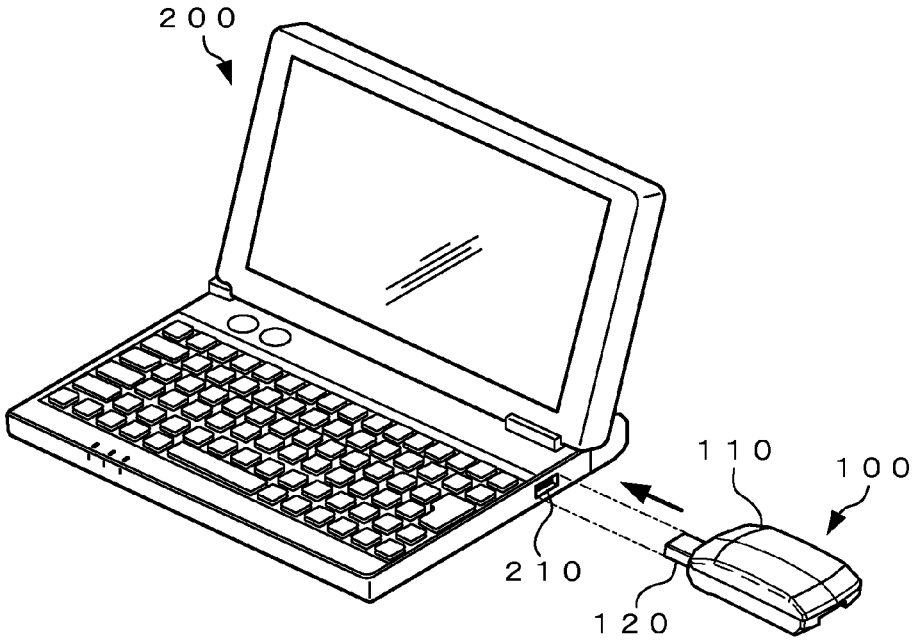
FIG. 1A and FIG. 1B are schematic structural diagrams showing a first embodiment of an electronic device according to the present invention.

Hereafter, embodiments of an electronic device according to the present invention are described in detail with reference to the drawings.

Note that, although the embodiments described below are provided with various technically preferable limitations in order to carry out the present invention, these limitations are not intended to limit the scope of the present invention to the embodiments and examples shown in the drawings.

First Embodiment

Figure 1B:
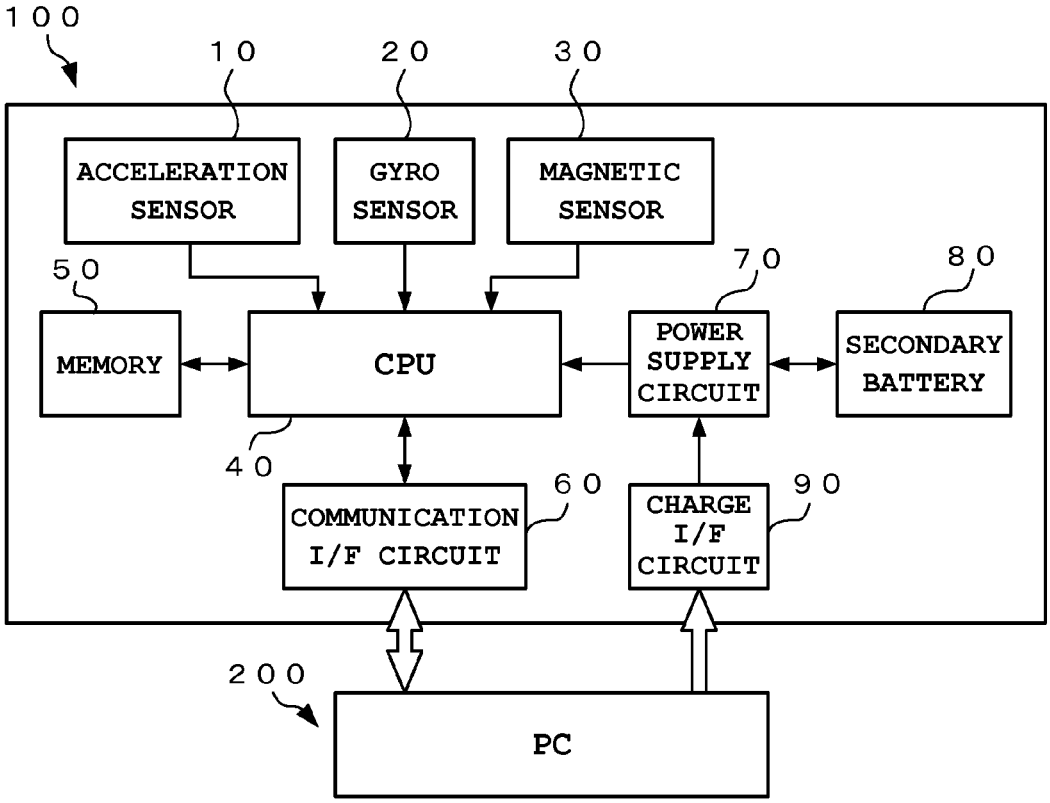

FIG. 1A and FIG. 1B are schematic structural diagrams showing a first embodiment of an electronic device according to the present invention.

FIG. 1A is a schematic view showing a method for connecting the electronic device according to the present embodiment to another electronic device, and FIG. 1B is a schematic block diagram showing the internal circuit of the electronic device.

In the embodiment described herein, the electronic device according to the present invention has been applied as an exercise data collecting device (so-called logger) including a motion sensor, which is connected to an electronic device such as a personal computer serving as an exercise data analyzing device (hereinafter referred to as "external device") for data transmission and power feeding to a secondary battery.

Note that the present invention is not limited to this embodiment and can be favorably applied to any device that performs data transmission and power feeding to and from various external devices.

The electronic device according to the first embodiment is, for example, an electronic device 100 that collects various sensor data such as those during exercise of a device user (user), as shown in FIG. 1A.

This electronic device 100 has a device body 110 and a connector section 120 having a plug structure protruding from the device body 110. By the connector section 120 protruding from the device body 110 being inserted into a plug inserting section 210 of an external device 200 such as a personal computer, the electronic device 100 and the external device 200 are electrically connected to each other.

Here, in the present embodiment, the connector section 120 has a plug shape corresponding to general purpose interface (I/F) standards for wired communication.

In the electronic device 100 according to the present embodiment, for example, an acceleration sensor 10, a gyro sensor 20, and a magnetic sensor 30 are included, as shown in FIG. 1B. By a predetermined control program being executed by a CPU 40 therein, sensor data (such as acceleration, angular velocity, and geomagnetism) of the user during exercise is measured and accumulated in a memory 50.

Then, by being connected to the external device 200 via the connector section 120, the electronic device 100 transfers the sensor data accumulated in the memory 50 to the external device 200 via a communication I/F circuit 60 in response to, for example, an instruction from the external device 200.

In the electronic device 100, for example, a power supply circuit 70 charges a secondary battery 80 with electric power supplied from the external device 200 via a charge I/F circuit 90.

Then, the electric power charged to the secondary battery 80 is supplied to each section of the electronic device 100 by the power supply circuit 70 as driving electric power.

This electronic device 100 is worn on, for example, portion on a body axis passing through a human body such as the chest, the neck, or the abdomen of the human body, a portion along the body trunk, or a nearby portion. As a method for wearing the electronic device 100, various wearing methods can be adopted, such as a method where the electronic device 100 is clipped on exercise clothes, a method where the electronic device 100 is taped, and a method where the electronic device 100 is wound around a body by a belt or the like.

First Specific Example

Next, specific structures of the electronic device according to the present embodiment are described.

FIG. 2A to FIG. 2G are structural diagrams showing a first specific example of the electronic device according to the first embodiment.

FIG. 2A is a planar view showing the device body of the electronic device, FIG. 2B is a planar view showing the connector section of the electronic device, and FIG. 2C is a perspective view showing a method for attaching the connector section to the device body.

FIG. 2D and FIG. 2E are perspective and planar views respectively showing an attached state of the connector section, and FIG. 2F and FIG. 2G are perspective and planar views respectively showing a sliding state of the connector section.

The electronic device according to the first specific example of the present embodiment has, for example, the device body 110 where a slide groove (installation section) 113 linearly extending in a specific direction (vertical direction in FIG. 2A) has been provided on one outer surface side of a body case 111, and the connector section 120 including a plug section (functional section) 123 structured to be removable from the slide groove 113 of the device body 110 and to be directly connected to the external device 200, as shown in FIG. 2A to FIG. 2C.

The device body 110 has, for example, the internal circuit shown in FIG. 1B, and at least four terminals (hereinafter collectively referred to as "connection terminals 112") including communication connection terminals (D− and D+) 112*b* and 112*c* of the communication I/F circuit 60 and power feeding connection terminals (Vbus and GND) 112*a* and 112*d* of the charge I/F circuit 90 are exposed on the inner surface of the slide groove 113, as shown in FIG. 2A and FIG. 2C.

Here, as will be described further below, the connection terminals 112 may have any structure as long as they can come in contact with connection terminals 122 provided to the connector section 120 for electrical connection. For example, a structure may be adopted in which the connection terminals 112 are embedded such that portions of their plate-shaped electrodes are exposed on the body case 111, or a structure may be adopted in which portions of the electrodes resiliently protrude from the front surface of the body case 111 by a resilient member such as a spring member.

Inside the slide groove 113 of the device body 110, there are provided a mechanism (falloff prevention mechanism) for holding the connector section 120 so that the connector section 120 does not easily fall off the slide groove 113 when it is attached and the plug section 123 slides to an end position to protrude from the device body 110, and a mechanism (sliding mechanism) for sliding the connector section 120 from an attached position (starting position) to the end position along the extending direction of the slide groove 113.

Note that the falloff prevention mechanism and the sliding mechanism applied in the electronic device 100 according to the present invention will be described in detail in the embodiments described further below.

The connector section 120 has, for example, a connector body 121 and the plug section 123, as shown in FIG. 2B and FIG. 2C. On one surface side of the connector body 121 which comes in contact with the connection terminals 112 when attached to the slide groove 113, at least four terminals (hereinafter collectively referred to as "connection terminals 122"; first terminal group) including communication connection terminals 122*b* and 122*c* and power feeding connection terminals 122*a* and 122*d* are exposed.

These connection terminals 122 have been electrically connected to the plug section 123 provided protruding from the connector body 121.

The plug section 123 has a plug shape of, for example, USB TYPE-A, which meets general purpose interface standards for wired communication.

Note that the connection terminals 122 may have any structure as long as they can come in contact with the connection terminals 112 of the device body 110 and be electrically connected thereto.

Specifically, in a case where the connection terminals 112 provided to the device body 110 have the structure where portions of their electrodes resiliently protrude from the front surface of the body case 111, the connection terminals 122 provided to the connector section 120 may have a structure where the connection terminals 122 are embedded such that portions of their plate-shaped electrodes are exposed on the connector body 121.

Also, in a case where the connection terminals 112 provided to the device body 110 have the structure where they are embedded such that part of their plate-shaped electrodes are exposed on the body case 111, the connection terminals 122 provided to the connector section 120 may have a structure where portions of their electrodes resiliently protrudes from the front surface of the connector body 121.

When connecting the electronic device 100 structured as described above to the external device 200, the user first attaches the connector section 120 to the device body 110 which has collected sensor data acquired during exercise or the like, as shown in FIG. 2C and FIG. 2D. Specifically, the connector section 120 is attached to the device body 110 by the outer surface of the connector body 121 of the connector section 120 coming in contact with and engaging with the inner surface of the slide groove 113 provided to the body case 111 of the device body 110.

In this attached state, the connector section 120 is at an initial position (housed state) in the slide groove 113, at which the plug section 123 has not externally protruded from the device body 110, as shown in FIG. 2D and FIG. 2E. Here, the connection terminals 122 of the connector section 120 and the connection terminals 112 of the device body 110 are away from each other and have not come in contact with each other. Accordingly, they have not been electrically connected to each other.

Next, the user slides the connector section 120 attached to the device body 110 in a direction in which the plug section 123 protrudes from the device body 110, as shown in FIG. 2F and FIG. 2G.

Specifically, the outer surface of the connector body 121 is slid along the inner surface of the slide groove 113 in a direction (indicated by arrows in the drawings) in which the plug section 123 protrudes from the device body 110, whereby the connector section 120 is slid along the extending direction of the slide groove 113 to the end position.

Here, in the state of being attached to and slid in the slide groove 113 (that is, when being slid or when at the end position), the connector section 120 has been engaged with the slide groove 113 by the falloff prevention mechanism provided to the inner surface of the slide groove 113 and the outer surface of the connector body 121, so that it does not fall off the body case 111.

At the slide end position, at least the plug section 123 of the connector section 120 enters a state (protruding state) of externally protruding from an end portion of the device body 110 (body case 111) by a predetermined length required for connection to the external device 200, as shown in FIG. 2F and FIG. 2G. Here, the connection terminals 122 of the connector section 120 and the connection terminals 112 of the device body 110 come in contact with each other in a one-to-one relation and are electrically connected to each other, as shown in FIG. 2F and FIG. 2G.

Specifically, the communication connection terminals (D− and D+) 112*b* and 112*c* of the device body 110 shown in FIG. 2A and FIG. 2B are electrically connected to the communication connection terminals 122*b* and 122*c* of the connector section 120, respectively, and the power feeding connection terminals (Vbus and GND) 112*a* and 112*d* of the device body 110 are electrically connected to the power feeding connection terminals 122*a* and 122*d* of the connector section 120, respectively. As a result, the internal circuit of the device body 110 and the plug section 123 of the connector section 120 are electrically connected to each other.

Then, when the user directly inserts the plug section 123 of the connector section 120 into the plug inserting section 210 of the external device 200 for connection, data transmission is favorably performed between the electronic device 100 and the external device 200 by the simple structure without a communication cable or the like, and the electronic device 100 is favorably charged with electric power supplied from the external device 200.

Second Specific Example

Next, a second specific example of the electronic device according to the present embodiment is described.

FIG. 3A to FIG. 3G are structural diagrams showing the second specific example of the electronic device according to the present embodiment.

Figures 3A, 3B, 3C, 3D, 3E, 3F, 3G:
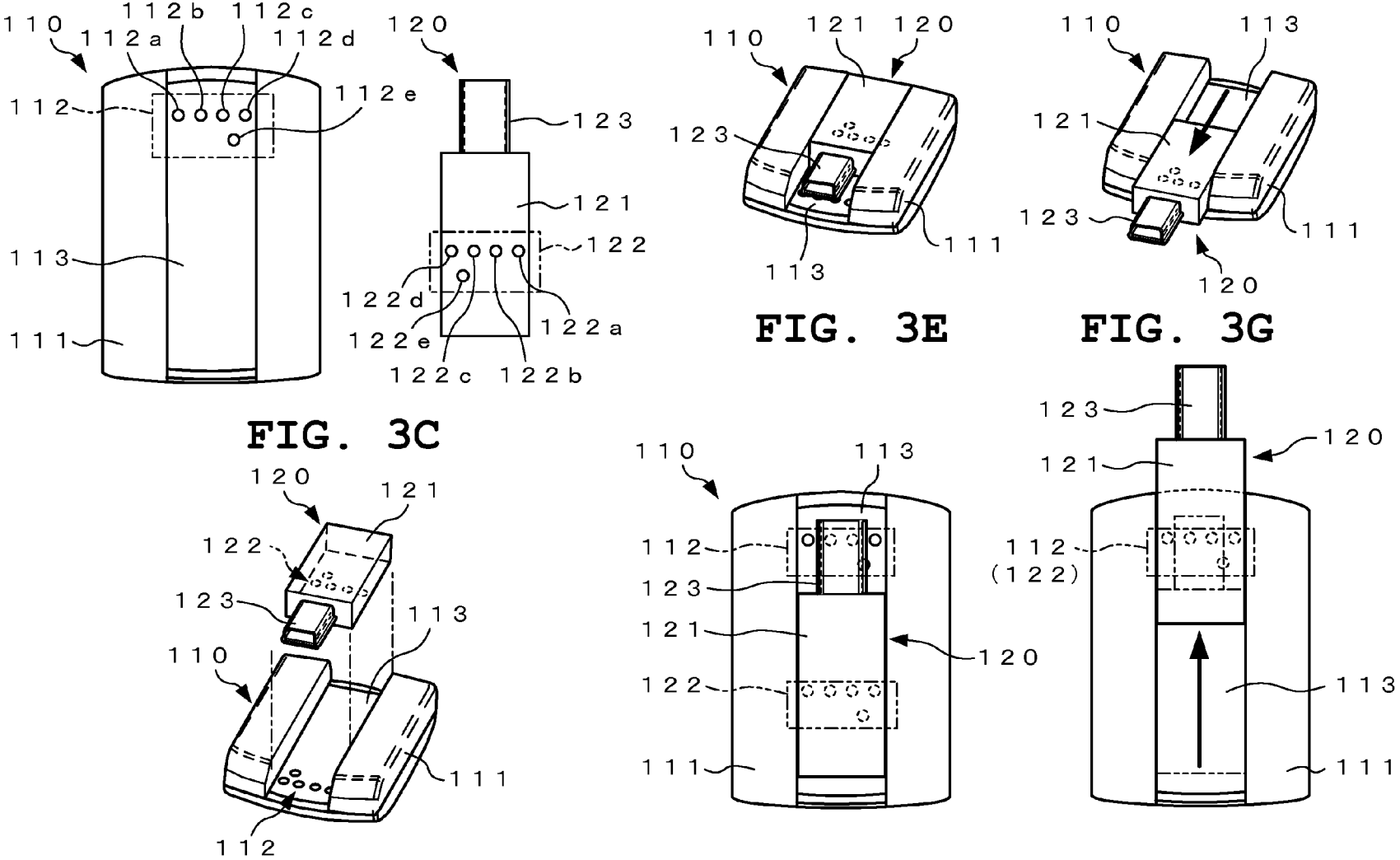
FIG. 3A to FIG. 3G are structural diagrams showing a second specific example of the electronic device according to the first embodiment.

FIG. 3A is a planar view showing the device body of the electronic device, FIG. 3B is a planar view showing the connector section of the electronic device, and FIG. 3C is a perspective view showing a method for attaching the connector section to the device body.

FIG. 3D and FIG. 3E are perspective and planar views respectively showing an attached state of the connector section, and FIG. 3F and FIG. 3G are perspective and planar views respectively showing a sliding state of the connector section.

Note that descriptions of sections equivalent to those of the first specific example described above are simplified.

The electronic device according to the second specific example has a structure where at least five terminals (hereinafter collectively referred to as "connection terminals 112") including a communication connection terminal (ID) 112*e* of the communication I/F circuit 60 in addition to the communication connection terminals (D− and D+) 112*b* and 112*c* and the power feeding connection terminals (Vbus and GND) 112*a* and 112*d* are exposed on the inner surface of the slide groove 113 having a structure equivalent to that of the first specific example, as shown in FIG. 3A and FIG. 3C.

The connector section 120 has a structure where at least five terminals (hereinafter collectively referred to as "connection terminals 122") including a communication connection terminal 122*e* in addition to the communication connection terminals 122*b* and 122*c* and the power feeding connection terminals 122*a* and 122*d* are exposed on one surface side of the connector body 121, as shown in FIG. 3B and FIG. 3C.

The plug section 123 has a plug shape of, for example, USB TYPE-mini B which meets general purpose interface standards for wired communication, and is electrically connected to the connection terminals 122.

As with the above-described first specific example, when connecting the electronic device 100 structured as described above to the external device 200, the user attaches the connector section 120 to the slide groove 113 of the device body 110, as shown in FIG. 3C to FIG. 3E.

Next, the user slides the connector section 120 to the end position such that the plug section 123 protrudes from the end portion of the device body 110, as shown in FIG. 3F and FIG. 3G. Here, the connection terminals 122 of the connector section 120 and the connection terminals 112 of the device body 110 come in contact with each other in a one-to-one relation and are electrically connected to each other, whereby the internal circuit of the device body 110 and the plug section 123 of the connector section 120 are electrically connected to each other, as shown in FIG. 3F and FIG. 3G.

Then, when the user directly inserts the plug section 123 of the connector section 120 into the plug inserting section 210 of USB TYPE-mini B of the external device 200 for connection, data transmission and power feeding (charging) are favorably performed between the electronic device 100 and the external device 200 by the simple structure without a communication cable or the like.

In the above-described electronic device 100, the functions of the four terminals (112*a* to 112*d*) among the five terminals exposed on the inner surface of the slide groove 113 of the device body 110 are the same as those of the connection terminals 112 shown in the first specific example. Accordingly, when the four terminals are arranged in the same manner as that of first specific example, and the connector section 120 including the plug section 123 having a plug shape of USB TYPE-A shown in the first specific example is attached to the slide groove 113 of the device body 110 of the present specific example, data transmission and power feeding (charging) can be performed also between the electronic device 100 and the external device 200 having the plug inserting section 210 of USB TYPE-A.

That is, the electronic device according to the present embodiment has a so-called replacement adapter structure in which, from among a plurality of connector sections 120 having plug sections 123 of different plug shapes, a suitable connector section 120 is selected and attached according to the interface standards and the type of an external device 200 serving as a connection target.

As a result, by a simple operation of switching the connector section 120, the electronic device can be favorably connected to any external device among external devices of different interface standards without being limited by the interface standards of the external devices or requiring a conversion cable or the like.

Third Specific Example

Next, a third specific example of the electronic device according to the present embodiment is described.

FIG. 4A to FIG. 4G are structural diagrams showing the third specific example of the electronic device according to the present embodiment.

Figure 4F:
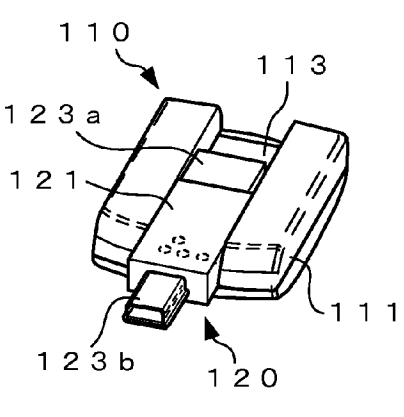
FIG. 4A to FIG. 4G are structural diagrams showing a third specific example of the electronic device according to the first embodiment.
Figure 4D:
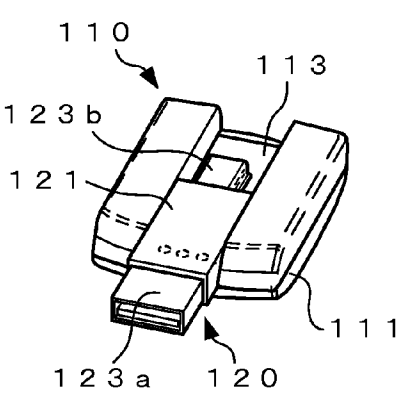
Figure 4B:
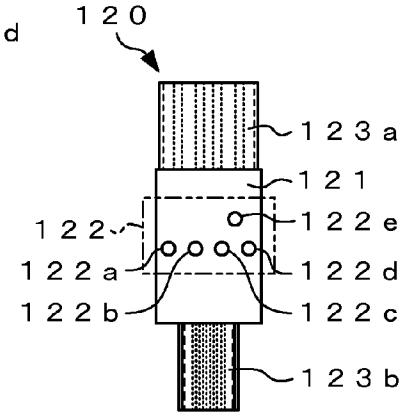
Figure 4A:
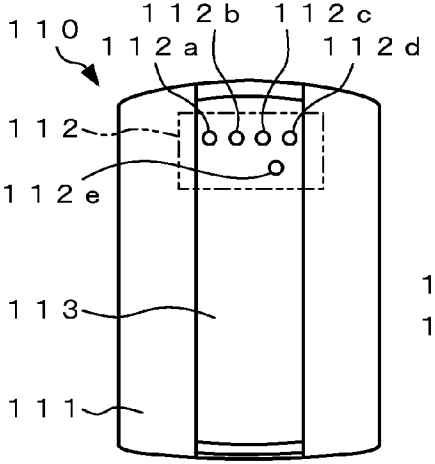
Figure 4G:
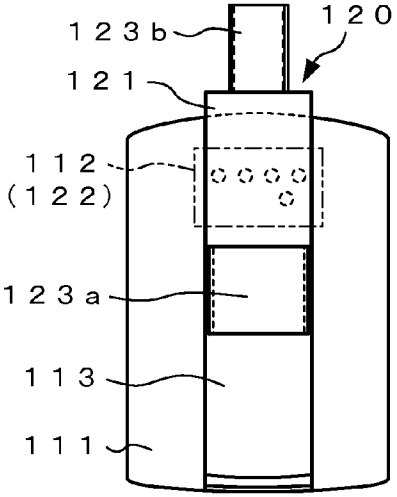
Figure 4E:
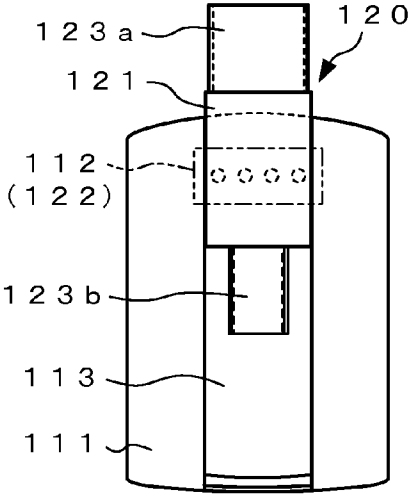
Figure 4C:
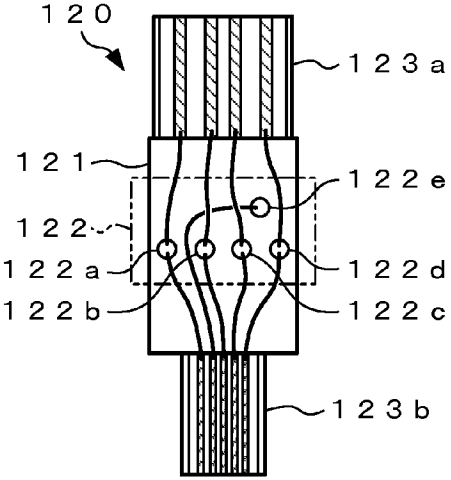

FIG. 4A is a planar view showing the device body of the electronic device, FIG. 4B is a planar view showing the connector section of the electronic device, and FIG. 4C is a diagram showing an example of the internal wiring of the connector section.

FIG. 4D and FIG. 4E are diagrams for describing first attached and sliding states of the connector section, and FIG. 4F and FIG. 4G are diagrams for describing second attached and sliding states of the connector section.

Note that descriptions of sections equivalent to those of the first or second specific examples described above are simplified.

In the electronic device according to the third specific example, for example, the device body 110 has a structure similar to that of the second specific example, in which the connection terminals 112 (communication connection terminals 112*b*, 112*c*, and 112*e* and power feeding connection terminals 112*a* and 112*d*) are exposed on the inner surface of the slide groove 113, as shown in FIG. 4A.

The connector section 120 has a structure in which plug sections 123*a* and 123*b* have been provided protruding from both end surfaces (upper surface and lower surface in the drawing) of the connector body 121 opposed to each other, as shown in FIG. 4B.

Specifically, the plug section 123*a* has a plug shape of USE TYPE-A which is general purpose interface standards, and the plug section 123*b* has a plug shape of USE TYPE-mini B.

The connector section 120 has a structure equivalent to that of the second specific example, in which the connection terminals 122 are exposed on one surface side of the connector body 121, as shown in FIG. 4B.

Regarding the connecting relation among the plug sections 123*a* and 123*b* and the connection terminals 122, the communication connection terminals 122*b* and 122*c* have been connected to communication terminal electrodes (D− and D+) of the plug sections 123*a* and 123*b*, respectively, by inner wiring, as shown in FIG. 4C. The power feeding connection terminals 122*a* and 122*d* have been connected to power feeding terminal electrodes (Vbus and GND) of the plug sections 123*a* and 123*b*, respectively, by inner wiring. The communication connection terminal 122*e* has been connected to a communication terminal electrode (ID) of the plug section 123*b* by inner wiring.

When directly connecting the electronic device 100 structured as described above to the plug inserting section 210 of USB TYPE-A of the external device 200, the user inserts the connector section 120 into the slide groove 113 with the plug section 123*a* of the connector section 120 being oriented to the protruding side (upper side in FIG. 4A or FIG. 4E) of the slide groove 113 of the device body 110, as with the first specific example.

Then, the user slides the connector section 120 to the end position such that the plug section 123*a* protrudes from the end portion of the device body 110, as shown in FIG. 4D and FIG. 4E.

As a result, the connection terminals 122 (four terminals 122*a* to 122*d*) of the connector section 120 connected to the terminal electrodes of the plug section 123*a* and the connection terminals 112 (four terminals 112*a* to 112*d*) of the device body 110 come in contact with each other in a one-to-one relation, whereby the internal circuit of the device body 110 and the plug section 123*a* of the connector section 120 are electrically connected to each other.

On the other hand, when directly connecting the electronic device 100 to the plug inserting section 210 of USB TYPE-mini B of the external device 200, the user attaches the connector section 120 to the slide groove 113 with the plug section 123*b* of the connector section 120 being oriented to the protruding side (upper side in FIG. 4A or FIG. 4G) of the slide groove 113 of the device body 110, as with the case described in the second specific example.

Then, the user slides the connector section 120 to the end position such that the plug section 123*b* protrudes from the end portion of the device body 110, as shown in FIG. 4F and FIG. 4G.

As a result, the connection terminals 122 (five terminals 122*a* to 122*e*) of the connector section 120 connected to the terminal electrodes of the plug section 123*b* and the connection terminals 112 (five terminals 112*a* to 112*e*) of the device body 110 come in contact with each other in a one-to-one correspondence, whereby the internal circuit of the device body 110 and the plug section 123*b* of the connector section 120 are electrically connected to each other.

That is, in the present specific example, when the single connector section 120 is to be attached to the slide groove 113 of the device body 110, one of the plug sections 123*a* and 123*b* having different plug shapes which corresponds to the plug inserting section 210 of the external device 200 can be protruded from the device body 110 by the orientations of the plug sections 123*a* and 123*b* of the connector section 120 being changed.

As a result, the electronic device 100 can be directly connected to any of the plurality of external devices 200 of different interface standards by the simple structure without a communication cable or the like, and data transmission and power feeding (charging) can be favorably performed therebetween.

Note that, although the plug sections 123*a* and 123*b* provided protruding from the connector body 121 in the present specific example have a plug shape of USB TYPE-A and a plug shape of USB TYPE-mini B, the present specific example is not limited thereto.

That is, the plug sections to be applied to the connector section may be those of other interface standards as long as they have different plug shapes.

Fourth Specific Example

Next, a fourth specific example of the electronic device according to the present embodiment is described.

FIG. 5A to FIG. 5G are structural diagrams showing the fourth specific example of the electronic device according to the present embodiment.

Figures 5A, 5B, 5C, 5D, 5E, 5F, 5G:
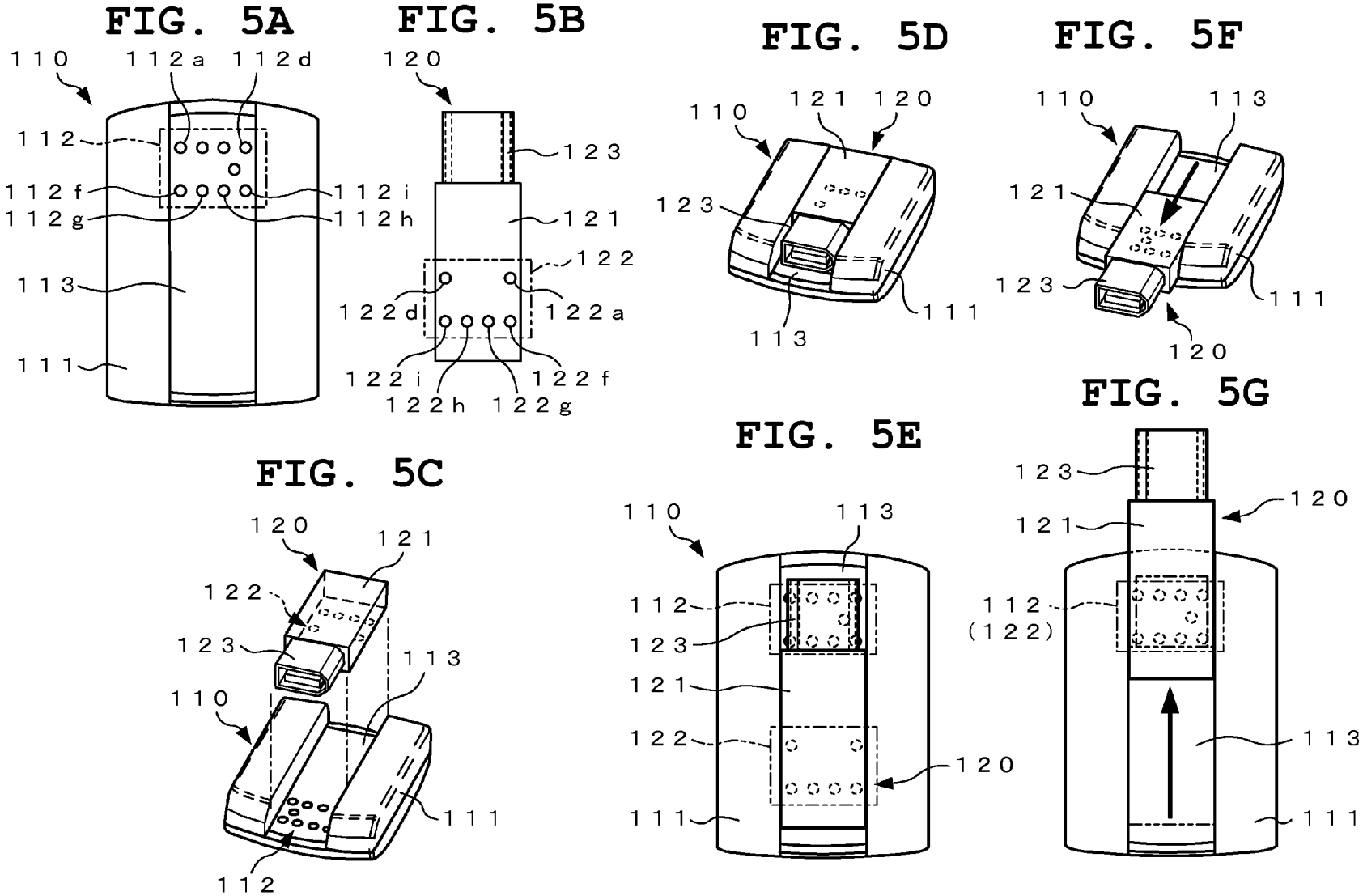
FIG. 5A to FIG. 5G are structural diagrams showing a fourth specific example of the electronic device according to the first embodiment.

FIG. 5A is a planar view showing the device body of the electronic device, FIG. 5B is a planar view showing the connector section of the electronic device, and FIG. 5C is a perspective view showing a method for attaching the connector section to the device body.

FIG. 5D and FIG. 5E are perspective and planar views respectively showing an attached state of the connector section, and FIG. 5F and FIG. 5G are perspective and planar views respectively showing a sliding state of the connector section. Note that descriptions of sections equivalent to those of the above-described specific examples are simplified.

In the electronic device according to the fourth specific example, the device body 110 has a structure where at least six terminals (hereinafter collectively referred to as "connection terminals 112") including communication connection terminals (TPA+, TPA−, TPB+, and TPB−) 112*f* to 112*i* and power feeding connection terminals (Vbus and GND) 112*a* and 112*d* are exposed on the inner surface of the slide groove 113 provided to the body case 111, as shown in FIG. 5A and FIG. 5C.

The connector section 120 has a structure where at least six terminals (hereinafter collective referred to as "connection terminals 122") including communication connection terminals 122*f* to 1221 and power feeding connection terminals 122*a* and 122*d* are exposed on one surface side of the connector body 121, as shown in FIG. 5B and FIG. 5C.

These connection terminals 122 have been electrically connected to the plug section 123 having a plug shape corresponding to IEEE 1394 which is general purpose interface standards for serial wired communication.

In the above-structured electronic device 100 as well, as with each specific example described above, the user attaches the connection section 120 to the slide groove 113 of the device body 110 as shown in FIG. 5C to FIG. 5E, and slides the connector section 120 to the end position as shown in FIGS. 5F and 5G. As a result, the plug section 123 protrudes from the end portion of the device body 110, and the connection terminals 122 of the connector section 120 and the connection terminals 112 of the device body 110 come in contact with each other in a one-to-one relation, whereby the internal circuit of the device body 110 and the plug section 123 of the connector section 120 are electrically connected to each other.

Therefore, the electronic device 100 and the external device 200 having the plug inserting section 210 of IEEE 1394 standards can be directly connected to each other by the simple structure without a communication cable or the like, and data transmission and power feeding can be favorably performed therebetween.

To the electronic device 100 structured as described above, a structure can also be applied in which, for example, connection terminals (112*b*, 112*c*, and 112*e*) arranged in the same manner as those of the above-described specific examples and having similar functions are provided to the inner surface of the slide groove 113 of the device body 110, in addition to the connection terminals (six terminals 112*a*, 112*d*, and 112*f* to 112*i*) corresponding to IEEE 1394.

By this structure, by switching to the connector section 120 including the plug section 123 having a plug shape of USB TYPE-A or USB TYPE-mini B shown in each specific example, the electronic device 100 can be directly connected not only to the external device 200 of IEEE 1394 standards but also to external devices of other interface standards, and data transmission and power feeding (charging) can be favorably performed therebetween.

Note that, although the plug section 123 provided protruding from the connector body 121 in the present embodiment has a plug shape of USB TYPE-A or USB TYPE-mini B or a plug shape corresponding to IEEE 1394, the specific examples are not limited thereto, and the plug section may have another plug shape as long as it meets the interface standards of the external device 200.

Second Embodiment

Next, a second embodiment of the electronic device according to the present invention is described.

FIG. 6A to FIG. 6E are structural diagrams showing a specific example of the electronic device according to the second embodiment.

Figure 6A:
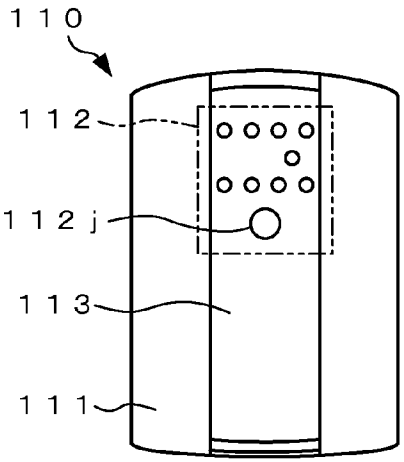
FIG. 6A to FIG. 6E are structural diagrams showing a specific example of an electronic device according to a second embodiment.
Figure 6B:
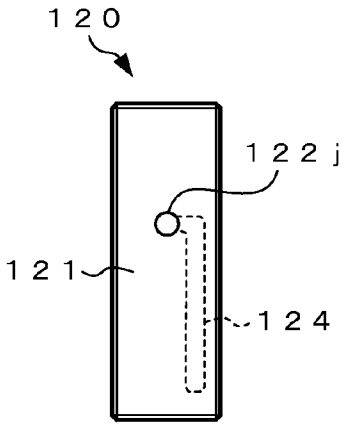
Figure 6D:
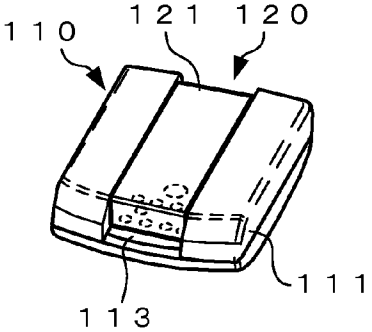
Figure 6C:
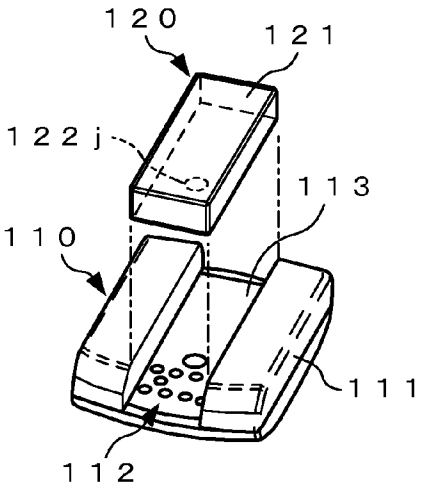

FIG. 6A is a planar view showing the device body of the electronic device, FIG. 6B is a planar view showing the connector section of the electronic device, and FIG. 6C is a perspective view showing a method for attaching the connector section to the device body.

Figure 6E:
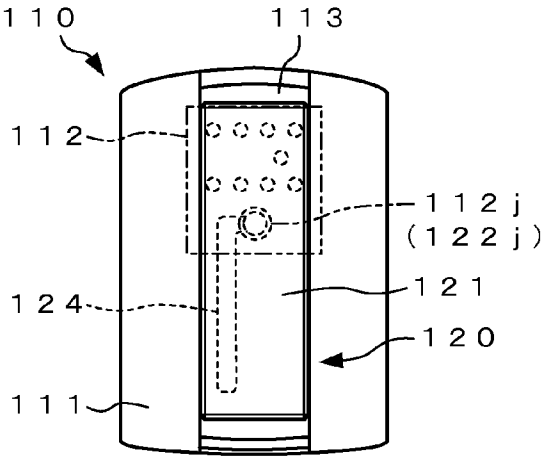

FIG. 6D and FIG. 6E are perspective and planar views respectively showing an attached state of the connector section.

Note that descriptions of sections equivalent to those of the above-described first embodiment are simplified.

In the electronic device according to the second embodiment, the device body 110 has a structure where at least an antenna connection terminal 112*j* of the communication I/F circuit 60 is exposed on the inner surface of the slide groove 113 provided to the body case 111, as shown in FIG. 6A and FIG. 6C.

The connector section 120 has a structure where at least an antenna connection terminal 122*j* is exposed on one surface side of the connector body 121, as shown in FIG. 6B and FIG. 6C.

Inside the connector body 121, an antenna element (such as a line antenna; functional section) 124 electrically connected to the connection terminal 122 have been provided.

Here, the antenna element 124 is to perform data transmission via wireless communication at least between the electronic device 100 and the external device 200. As the wireless communication method, general purpose wireless communication standards, such as Bluetooth (registered trademark) communication, WiFi (wireless fidelity (registered trademark)) communication, or high-speed mobile communication using a portable telephone network are adopted.

In the electronic device 100 structured as described above, when the user attaches the connector section 120 to the slide groove 113 of the device body 110, the antenna connection terminal 122*j* of the connector section 120 and the antenna connection terminal 112*j* of the device body 110 come in contact with each other in a one-to-one relation, whereby the internal circuit of the device body 110 and the antenna element 124 of the connector section 120 are electrically connected to each other, as shown in FIG. 6C to FIG. 6E.

Accordingly, by the simple structure where the connector section 120 is attached to the device body 110 and a simple operation therefor, the electronic device 100 can be wirelessly connected to the external device 200 of general purpose interface standards for wireless communication, and data transmission can be favorably performed therebetween.

To the electronic device 100 structured as described above, a structure can also be applied in which, for example, connection terminals (112*a* to 112*i*) arranged in the same manner as those of each specific example of the above-described first embodiment and having similar functions are provided to the inner surface of the slide groove 113 of the device body 110, in addition to the antenna connection terminal 112*j* for wireless communication.

By this structure, by switching to the connector section 120 including the plug section 123 having a plug shape of USE TYPE-A, USE TYPE-mini B, or IEEE 1394 shown in the first embodiment, the electronic device 100 can be directly connected to external devices of other interface standards not only in wireless communication but also in wired communication, and data transmission and power feeding (charging) can be favorably performed therebetween.

Third Embodiment

Next, a third embodiment of the electronic device according to the present invention is described.

FIG. 7A to FIG. 7D are structural diagrams showing the electronic device according to the third embodiment.

Figure 7A:
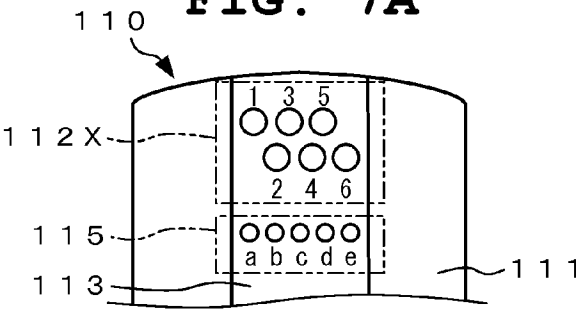
FIG. 7A to FIG. 7D are diagrams describing an electronic device according to a third embodiment.
Figure 7B:
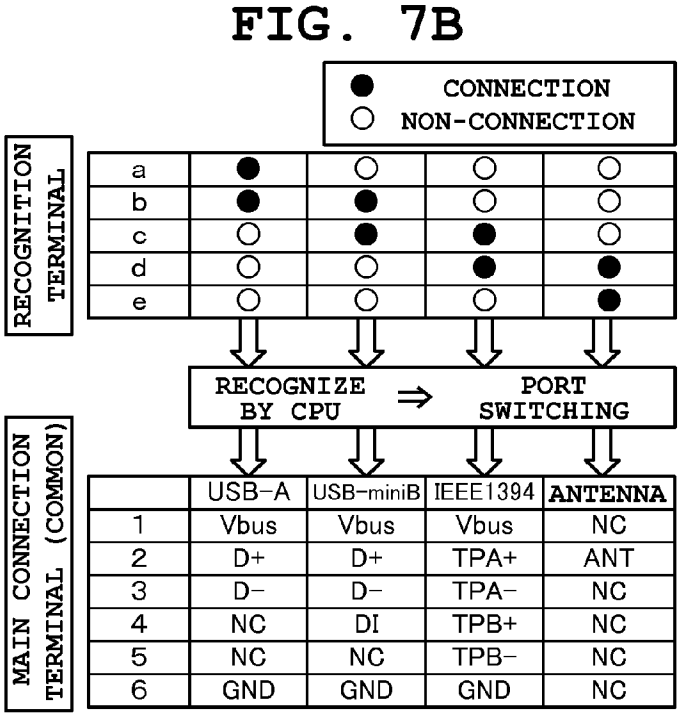

FIG. 7A is a schematic structural diagram showing the main portion of a first specific example of the electronic device, and FIG. 7B is a diagram for describing a recognition function by a connector section in the first specific example.

Figure 7C:
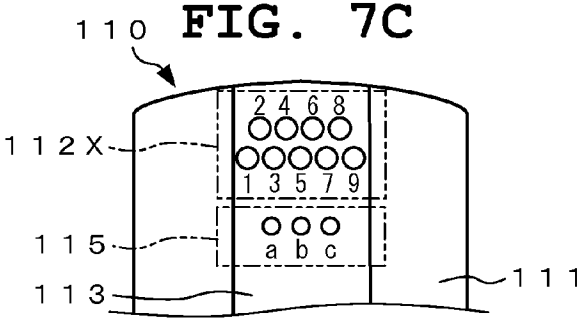
Figure 7D:
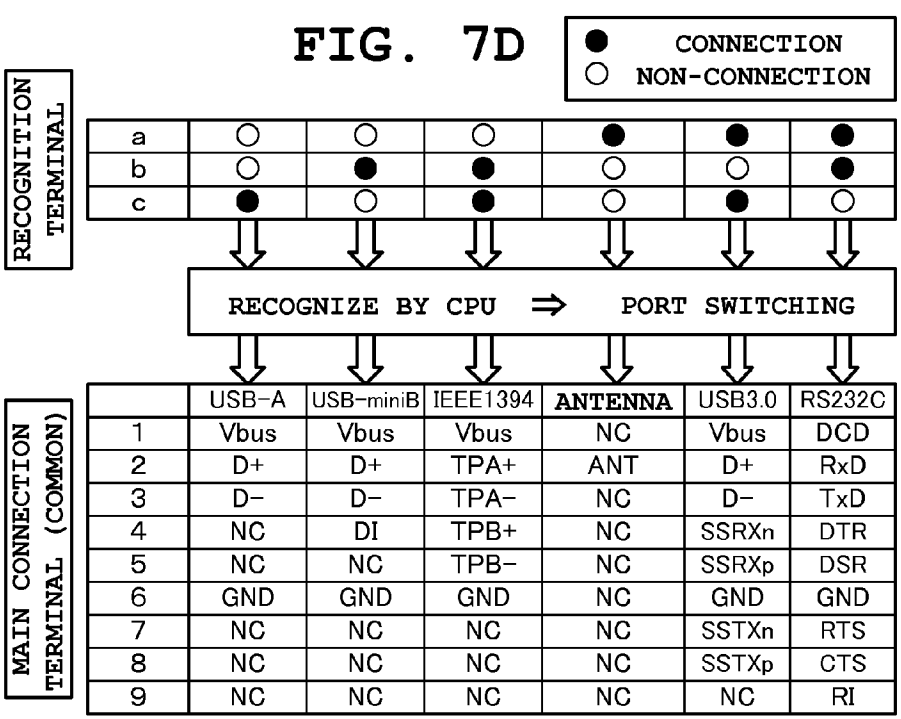

FIG. 7C is a schematic structural diagram showing the main portion of a second specific example of the electronic device, and FIG. 7D is a diagram for describing a recognition function by a connector section in the second specific example.

Figure 8:
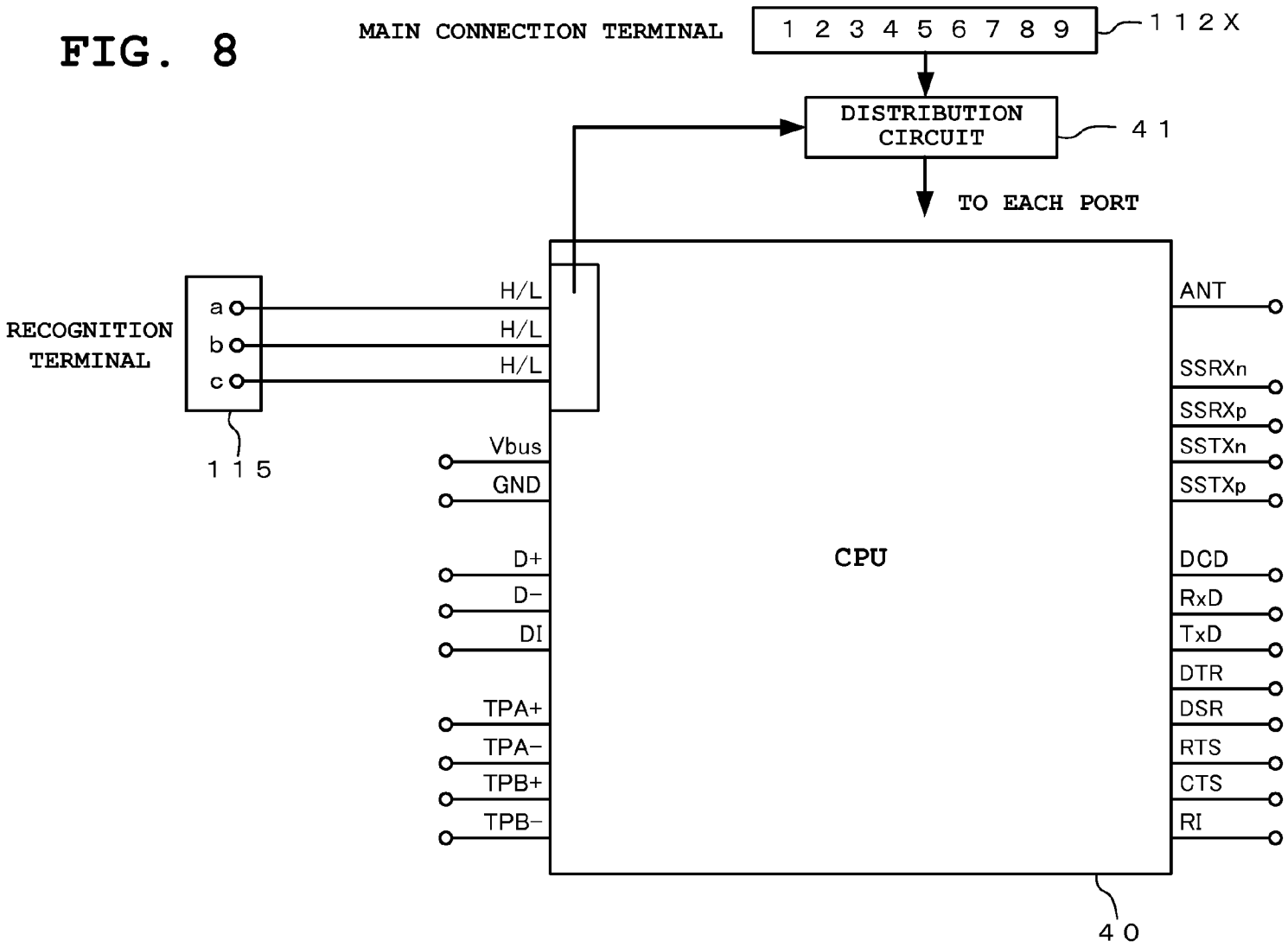
FIG. 8 is a schematic structural diagram for describing processing for recognizing a connector section and processing for switching input/output ports in a second specific example of the third embodiment.

FIG. 8 is a schematic structural diagram for describing processing for recognizing the connector section and processing for switching input/output ports in the second specific example of the electronic device.

FIG. 9A to FIG. 9H are schematic diagrams showing examples (first to fourth examples) of attached and sliding states of the connector section in the second specific example of the electronic device.

Note that descriptions of sections equivalent to those of the above-described embodiments are simplified.

First Specific Example

In the electronic device according to the first specific example of the third embodiment, the device body 110 has a structure where main connection terminals 112X and recognition terminals (fourth terminal group) 115 electrically connected to the internal circuit are exposed on the inner surface of the slide groove 113 provided in the body case 111, as shown in FIG. 7A.

The main connection terminals 112X include six connection terminals (indicated by "1" to "6" in the drawing) including communication connection terminals and power feeding connection terminals.

The recognition terminals 115 include five connection terminals (indicated by "a" to "e" in the drawing) for recognizing (identifying) the type of the connector section 120 attached to the device body 110.

The connector section 120 has a structure where communication and power feeding connection terminals are exposed at positions on one surface side of the connector body 121 which correspond to the main connection terminals 112X exposed on the device body 110 side, and type-specific terminals (third terminal group) 125 are exposed at positions corresponding to the recognition terminals 115.

Here, the number and the arrangement of the communication and power feeding connection terminals and recognition terminals exposed on the connector section 120 have been set according to the number of the types of connector sections that are attachable to the device body 110.

In the present specific example, processing for recognizing the type of the connector section 120 is performed by the CPU 40 in the device body 110 according to the connection statuses (a combination of connection and non-connection) of the recognition terminals 115 constituted by the five connection terminals a to e and the recognition terminals of the connector section 120 when the connector section 120 is attached to the device body 110 or is attached to and slid in the device body 110, as shown in FIG. 73.

Then, based on the results of the recognition processing, the switching of input/output ports of the CPU 40 is performed.

That is, according to the type of the connector section 120, the six connection terminals 1 to 6 of the main connection terminals 112X are each switched to a predetermined input/output port of the CPU 40, and the communication and power feeding connection terminals of the attached connector section 120 are electrically connected to the predetermined input/output ports via the connection terminals 1 to 6 of the main connection terminals 112X.

Alternatively, some of the connection terminals 1 to 6 of the main connection terminals 112X are set to a non-connected state (NC).

Second Specific Example

In an electronic device according to a second specific example of the present embodiment, the device body 110 has a structure where main connection terminals 112X constituted by nine connection terminals (indicated by "1" to "9" in the drawing) and recognition terminals 115 constituted by three connection terminals (indicated by "a" to "c" in the drawing) electrically connected to the internal circuit are exposed on the inner surface of the slide groove 113 provided in the body case 111, as shown in FIG. 7C.

As with the first specific example, the main connection terminals 112X include communication connection terminals and power feeding connection terminals, and the recognition terminals 115 are used to recognize (identifies) the type of the connector section 120.

The connector section 120 has a structure where the communication and power feeding connection terminals are exposed at positions corresponding to the main connection terminal 112X exposed on the device body 110 side and the recognition terminals are exposed at a position corresponding to the recognition terminals 115, as in the case of the first specific example.

In the present specific example as well, as with the first specific example, processing for recognizing the type of the connector section 120 is performed by the CPU 40 in FIG. 8 according to the connection statuses (a combination of connection and non-connection) of the recognition terminals 115 constituted by the three connection terminals a to c and the recognition terminals of the connector section 120 when the connector section 120 is attached to the device body 110 or is attached to and slid in the device body 110, as shown in FIG. 7D.

Then, based on the recognition result, the switching of input/output ports of the CPU 40 is performed.

As a result, according to the type of the connector section 120, the nine connection terminals 1 to 9 of the main connection terminals 112X are each switched to a predetermined input/output port of the CPU 40, and the communication and power feeding connection terminals of the connector section 120 are electrically connected to the predetermined input/output ports.

Alternatively, some of the connection terminals 1 to 9 of the main connection terminals 112X are set to a non-connected state (NC). In the following descriptions, this processing is specifically described.

For example, in a first example where the connector section 120 has the plug section 123 of USB TYPE-A as shown in FIG. 9A, the communication connection terminals 122 are provided to the connector body 121 such that they are exposed and correspond to two connection terminals 2 and 3 of the main connection terminals 112X of the device body 110 shown in FIG. 7C, and the power feeding connection terminals 122 are provided to the connector body 121 such that they are exposed and correspond to two connection terminals 1 and 6 thereof.

The type-specific terminal 125 is provided to the connector body 121 such that it is exposed and corresponds to one connection terminal c among the recognition terminals 115 of the device body 110.

Then, by the connector section 120 being attached to the device body 110 and slid, the connection terminal c of the device body 110 and the type-specific terminal 125 of the connector section 120 enter a connected state, as shown in FIG. 9B.

As a result, the type (USB TYPE-A) of the connector section 120 is recognized by the CPU 40 in the device body 110 as shown in FIG. 7D, and the connection between the connection terminals 1 to 9 of the main connection terminals 112X and the input/output ports of the CPU 40 is switched by a distribution circuit 41 shown in FIG. 8.

Specifically, two connection terminals 2 and 3 of the main connection terminal 112 are respectively connected to data communication ports (D− and D+), two connection terminals 1 and 6 are respectively connected to power feeding ports (Vbus and GND), and five connection terminals 4, 5, and 7 to 9 are set to a non-connected state (NC), as shown in FIG. 7D.

Therefore, the communication connection terminals 122 of the connector section 120 are connected to the data communication ports (D− and D+) via the connection terminals 2 and 3 of the main connection terminals 112X of the device body 110, and the power feeding connection terminals 122 of the connector section 120 are connected to the power feeding ports (Vbus and GND) via the connection terminals 1 and 6 of the main connection terminals 112X.

Note that the concept of this first example can be similarly applied in a case where the connector section 120 has the plug section 123 corresponding to USB TYPE-mini B (a second example), a case where the connector section 120 has the plug section 123 of a shape corresponding to IEEE 1394 (a third example), a case where an antenna element for wireless communication is incorporated (a fourth example), a case where the connector section 120 has the plug section 123 corresponding to USB 3.0 (a fifth example), and a case where the connector section 120 has the plug section 123 having a plug shape corresponding to RS232C (a sixth example), as shown in FIG. 7D and FIG. 9C to 9H.

As a result of this configuration, the type of a connector section is recognized by the CPU 40 in the device body 110 based on the number and the arrangement of type-specific terminals provided in the connector section, and the connection relation between the connection terminals of the main connection terminals 112X and the input/output ports of the CPU 40 is controlled to be switched.

As such, in the specific examples according to the present embodiment, the type of a connector section attached to the device body 110 is recognized by the use of recognition terminals, and the functions of a predetermined number of connection terminals provided to the device body 110 are switched, whereby the internal circuit of the device body 110 and the plug section 123 or the functional section such as the antenna element of the connector section 120 are electrically connected to each other favorably.

Therefore, even when there are plural types of connector sections to be attached to the device body 110, an increase in the number of connection terminals to be provided to the device body 110 and the connector section 120 can be prevented.

In this case as well, data transmission and power feeding (charging) can be favorably performed between the electronic device 100 and the external device 200 by the simple structure without a communication cable or the like, as with the above-described embodiments.

Fourth Embodiment

Next, a fourth embodiment of the electronic device according to the present invention is described.

FIG. 10A to FIG. 10F are structural diagrams showing a specific example of the electronic device according to the fourth embodiment.

Figures 10A, 10B, 10C, 10D, 10E, 10F:
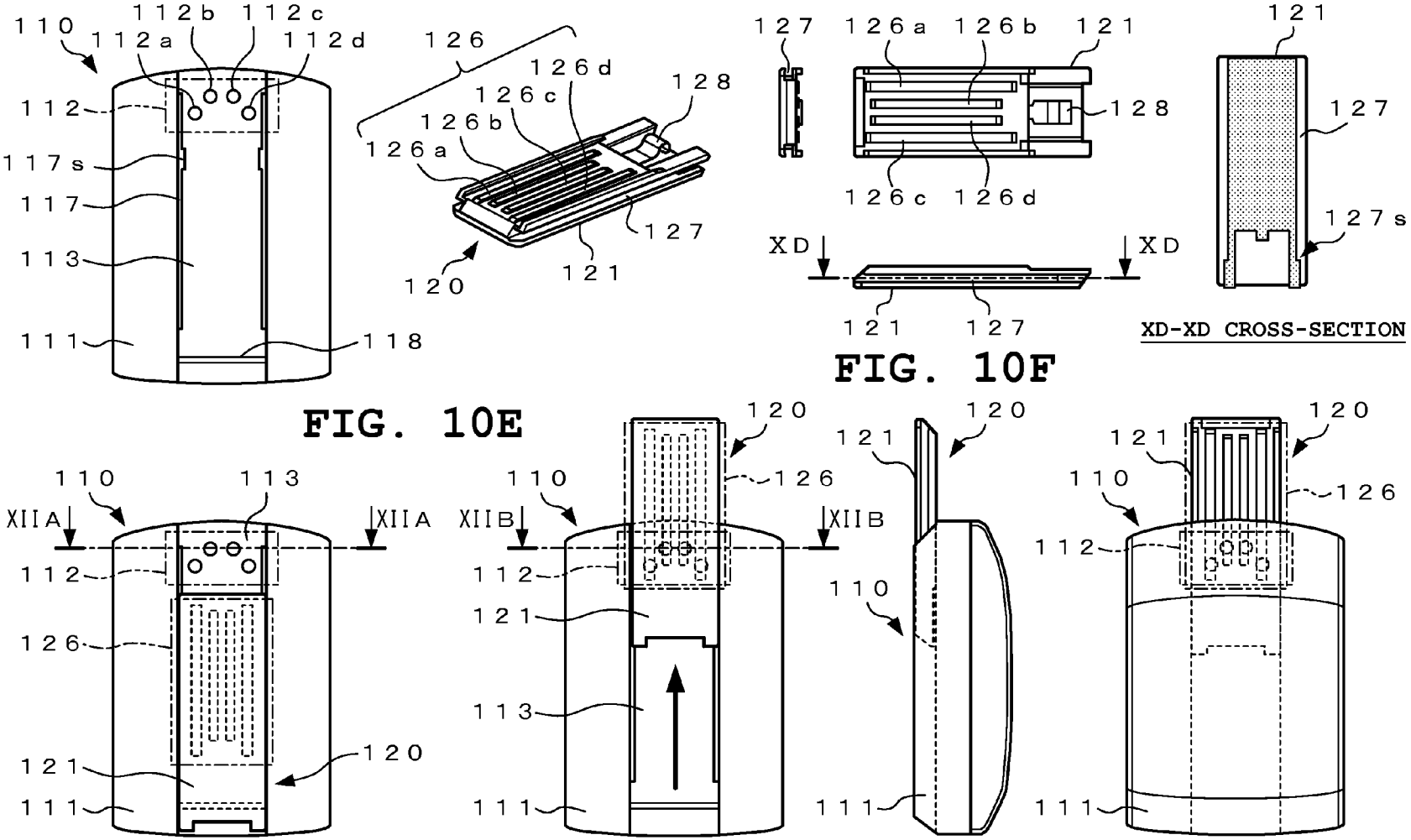
FIG. 10A to FIG. 10F are structural diagrams showing a specific example of an electronic device according to a fourth embodiment.

FIG. 10A is a planar view showing the device body of the electronic device, FIG. 10B is a planar view showing the connector section of the electronic device, FIG. 10C depicts planar and side views showing the connector section of the electronic device, and FIG. 10D is a sectional view showing the connector section of the electronic device.

FIG. 10E is a planar view showing an attached state of the connector section, and FIG. 10F shows planar and side views of a sliding state of the connector section.

FIG. 11A to FIG. 11E are schematic structural diagrams showing an example of a sliding mechanism of the connector section applied in the electronic device according to the present embodiment.

Figure 11A:
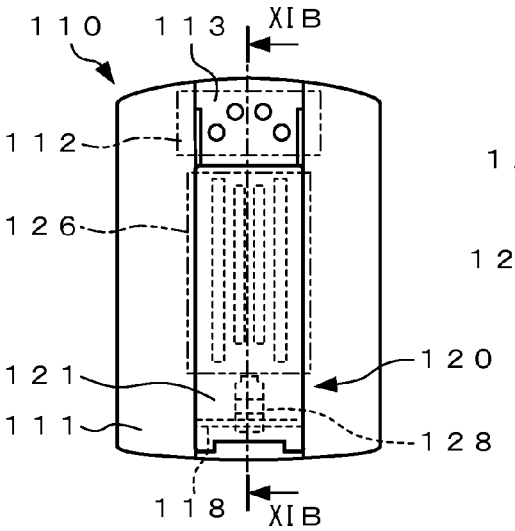
FIG. 11A to FIG. 11E are schematic structural diagrams showing an example of a slide mechanism of a connector section applied to the electronic device according to the fourth embodiment.
Figure 11B:
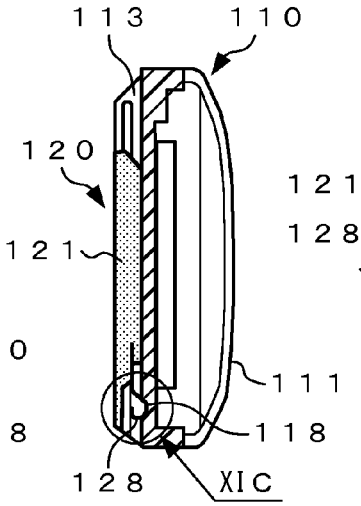
Figure 11C:
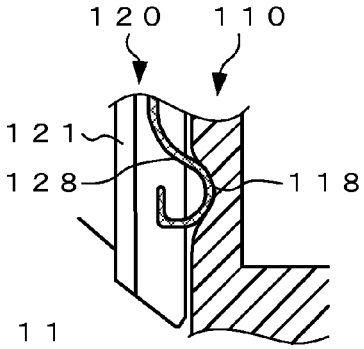

FIG. 11A is a planar view showing an attached state of the connector section, FIG. 11B is a sectional view of the attached state of the connector section, and FIG. 11C is a detailed diagram of the main portion showing the attached state of the connector section.

Figure 11D:
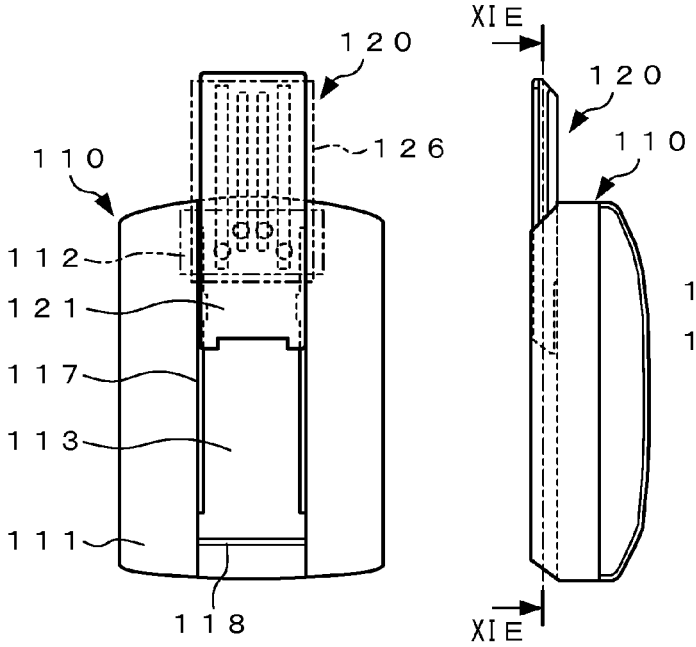
Figure 11E:
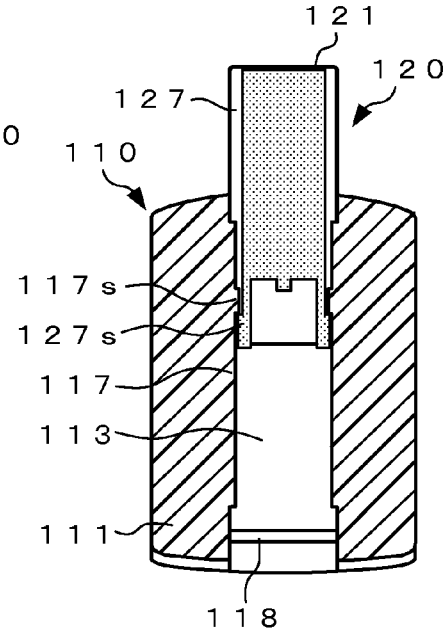

FIG. 11D shows planar and side views of a sliding state of the connector section, and FIG. 11E is a sectional view showing the sliding state of the connector section.

Figure 12A:
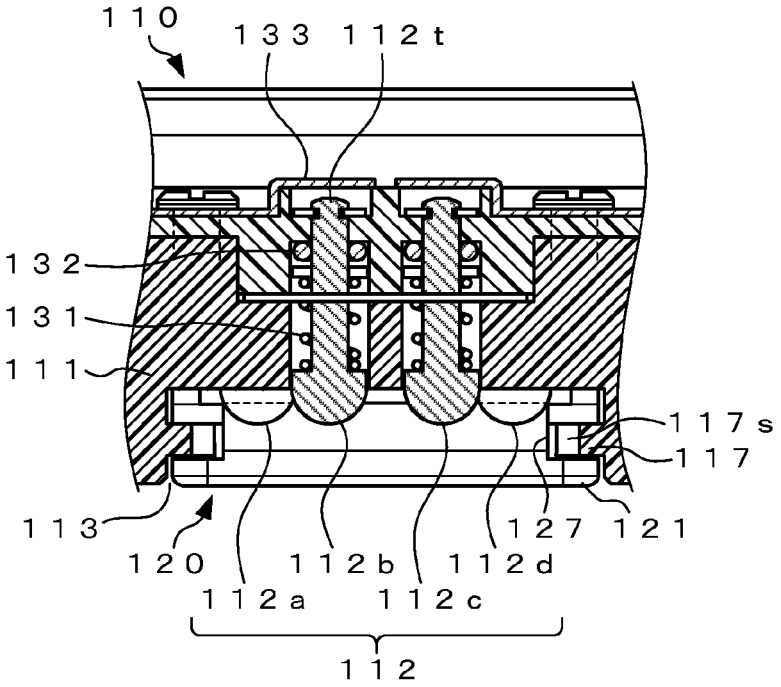
FIG. 12A and FIG. 12B are structural diagrams showing an example of a connection terminal structure applied in the electronic device according to the fourth embodiment.
Figure 12B:
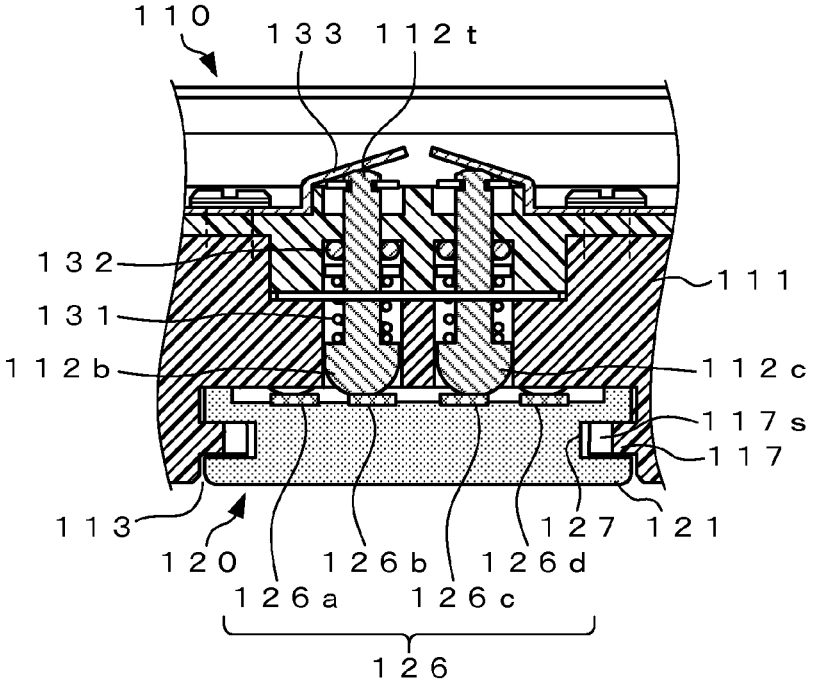

FIG. 12A and FIG. 12B are structural diagrams showing an example of a connection terminal structure applied in the electronic device according to the present embodiment.

Note that descriptions of sections equivalent to those of the above-described embodiments are simplified.

The electronic device according to the fourth embodiment includes, for example, the device body 110 having a structure equivalent to that of each embodiment described above and the connector section 120 that is removable from the slide groove 113 of the device body 110 and having a thin structure to be directly connected to the external device 200, as shown in FIG. 10A and FIG. 10B.

The device body 110 has a structure where at least a plurality of connection terminals 112 (112*a* to 112*d*) are exposed on the inner surface of the slide groove 113 provided in the body case 111, as shown in FIG. 10A.

Inside the slide groove 113 of the device body 110, a guide section 117 (sliding mechanism and falloff prevention mechanism) projecting toward the inside of the groove is provided along the extending direction (lower direction in the drawing) of the slide groove 113.

On a portion of the guide section 117 of the device body 110 on the connector protruding side (upper side in the drawing), a convex stopper section 117*s* for defining the end position of the sliding state of the connector section 120 is provided, which will be described further below.

On a portion inside the slide groove 113 of the device body 110 on the side opposite to the connector protruding side (lower side in the drawing), a concave stopper section 118 (falloff prevention mechanism) for defining the starting position (or attaching position) of the sliding state of the connector section 120 is provided.

Briefly, the connector section 120 has, for example, stick-shaped connection terminals 126 provided so as to be exposed on one surface side of the connector body 121 formed of a flat-plate-shaped insulating member, as shown in FIG. 10B and FIG. 10C.

Here, the connection terminals 126 have, for example, four terminals including communication connection terminals 126*b* and 126*c* and power feeding connection terminals 126*a* and 126*d*, which have been parallelly arranged extending in the longitudinal direction (lateral direction in FIG. 10C) of the connector body 121.

In particular, in the present embodiment, the plate-shaped connector body 121 and the connection terminals 126 have sizes and arrangement structures equivalent to those of a substrate and terminal electrodes provided inside a plug of USB TYPE-A (refer to FIG. 4C), and the connector section 120 has, in brief, a shape of a plug of USB TYPE-A with a metal shell excluded therefrom.

On each side surface of the connector body 121 in the longitudinal direction, a guide groove 127 (sliding mechanism and falloff prevention mechanism) is provided which engages with the guide section 117 projecting toward the inside of the slide groove 113 of the device body 110.

Inside the guide groove 127 of the connector body 121, a convex stopper section 127*s* is provided, as shown in FIG. 10D.

The convex stopper section 127*s* comes in contact with the convex stopper section 117*s* provided on the guide section 117 of the device body 110 so as to define the end position of the sliding state of the connector section 120 and prevent the connector section 120 from falling off the slide groove 113, as shown in FIG. 11D and FIG. 11E.

On one surface side of the connector body 121, a convex stopper section 128 is provided which engages with the concave stopper section 118 provided in the slide groove 113 of the device body 110 so as to define the starting position (or attaching position) of the sliding state of the connector section 120 and prevent the connector section 120 from falling off the slide groove 113, as shown in FIG. 11A to FIG. 11C.

Here, the convex stopper section 128 is resiliently protruding from one surface side of the connector body 121 by a resilient member such as a plate spring, as shown in FIG. 10B and FIG. 11C. As a result, the connector section 120 can be smoothly slid along the extending direction of the slide groove 113, and held not to fall off the slide groove 113.

In the electronic device 100 structured as described above, as with each embodiment described above, the user attaches the connector section 120 to the slide groove 113 of the device body 110 as shown in FIG. 10E, and slides it to the end position inside the slide groove 113 as shown in FIG. 10F.

As a result, the connection terminals 126 of the connector section 120 protrude from an end portion of the device body 110, and the connection terminals 126 of the connector section 120 and the connection terminals 112 of the device body 110 come in contact with each other in a one-to-one relation, whereby the internal circuit of the device body 110 and the connection terminals 126 of the connector section 120 are electrically connected to each other.

Then, when the user directly attaches the connector section 120 protruding from the end portion of the device body 110 to the plug inserting section 210 of USB TYPE-A of the external device 200 for connection, data transmission and power feeding (charging) can be favorably performed between the electronic device 100 and the external device 200 by the simple structure without a communication cable or the like.

In particular, since the connector section 120 has a shape of a plug of USB TYPE-A with a metal shell excluded therefrom in the present embodiment, the connector section 120 can be made thinner, and the thickness of the device body 110 where the connector section 120 is attached can also be made thinner, as compared to the case where the connector section 120 has a plug shape of normal USE TYPE-A (for example, refer to FIG. 2A to FIG. 2G).

Note that the connection terminals 112 exposed on the inner surface of the slide groove 113 of the device body 110 can each adopt a terminal structure such as that shown in FIG. 12A and FIG. 12B.

Specifically, in a case where each connection terminal 112 has a structure in which a portion of the electrode elastically protrudes from the inner surface of the slide groove 113, a terminal pin constituting the connection terminal 112 is constantly pressed by a coil spring 131 in an external direction of the device body 110 (that is, the direction of the slide groove 113; downward in the drawing), as shown in FIG. 12A.

Between the terminal pin constituting the connection terminal 112 and the body case 111, a gasket (for example, an O ring) 132 made of rubber for waterproofing is incorporated such that it comes in close contact with both of the terminal pin and the body case 111.

As a result, when the connector section 120 has not been attached to the device body 110 or when the attached connector section 120 has not been slid (when the connector section 120 has been attached to the starting position but has not been connected to the external device 200), an end portion of the connection terminal 112 (112*a* to 112*d*) on the slide groove 113 side (downward in the drawing) protrudes from the inside of the slide groove 113 and are exposed, as shown in FIG. 12A.

Here, the end portion 112*t* of the connection terminal 112 (112*a* to 112*d*) on the inner side (upward in the drawing) of the device body 110 is away from a body contact plate 133 connected to the internal circuit (omitted in the drawing) of the device body 110, and therefore has not been electrically connected.

That is, in a state where the electronic device 100 has not been connected to the external device 200 such as a state where the connector section 120 has not been attached or slid, the connection terminal 112 exposed on the device body 110 has not been electrically connected to the internal circuit. Therefore, electrical damages to the internal circuit such as a short circuit of the connection terminal 112 can be prevented.

Also, since the connection terminal 112 has a waterproof structure, the ingress of moisture into the inside of the device body 110 from outside can be prevented, and the waterproofness of the electronic device 100 can be ensured.

On the other hand, in a state where the connector section 120 has been attached to the device body 110 and slid (a state where the connector section 120 has been slid to the end position and is connectable to the external device 200), an end portion of the connection terminal 112 (112*a* to 112*d*) on the slide groove 113 side (downward in the drawing) has been pressed by coming in contact with one of the connection terminals 126 (126*a* to 126*d*) of the connector section 120, as shown in FIG. 12B.

Here, by the connection terminal 112 (112*a* to 112*d*) being pressed in the internal direction of the device body 110 against the pressing force of the coil spring 131, the end portion 112*t* of the connection terminal 112 comes in contact with and electrically connected to the body contact plate 133. As a result, the connection terminal 126 of the connector section 120 and the internal circuit of the device body 110 are electrically connected to each other.

Note that the sliding mechanism of the connector section shown in FIG. 11A to FIG. 11E and the terminal structure of the connection terminal shown in FIG. 12A and FIG. 12B are not limited to those of the present embodiment, and can be applied to the electronic device 100 (the device body 110 and the connector section 120) shown in each embodiment described above.

Modification Example

FIG. 13A to FIG. 13D are structural diagrams showing a modification example of the electronic device according to the fourth embodiment.

Figures 13A, 13B, 13C, 13D:
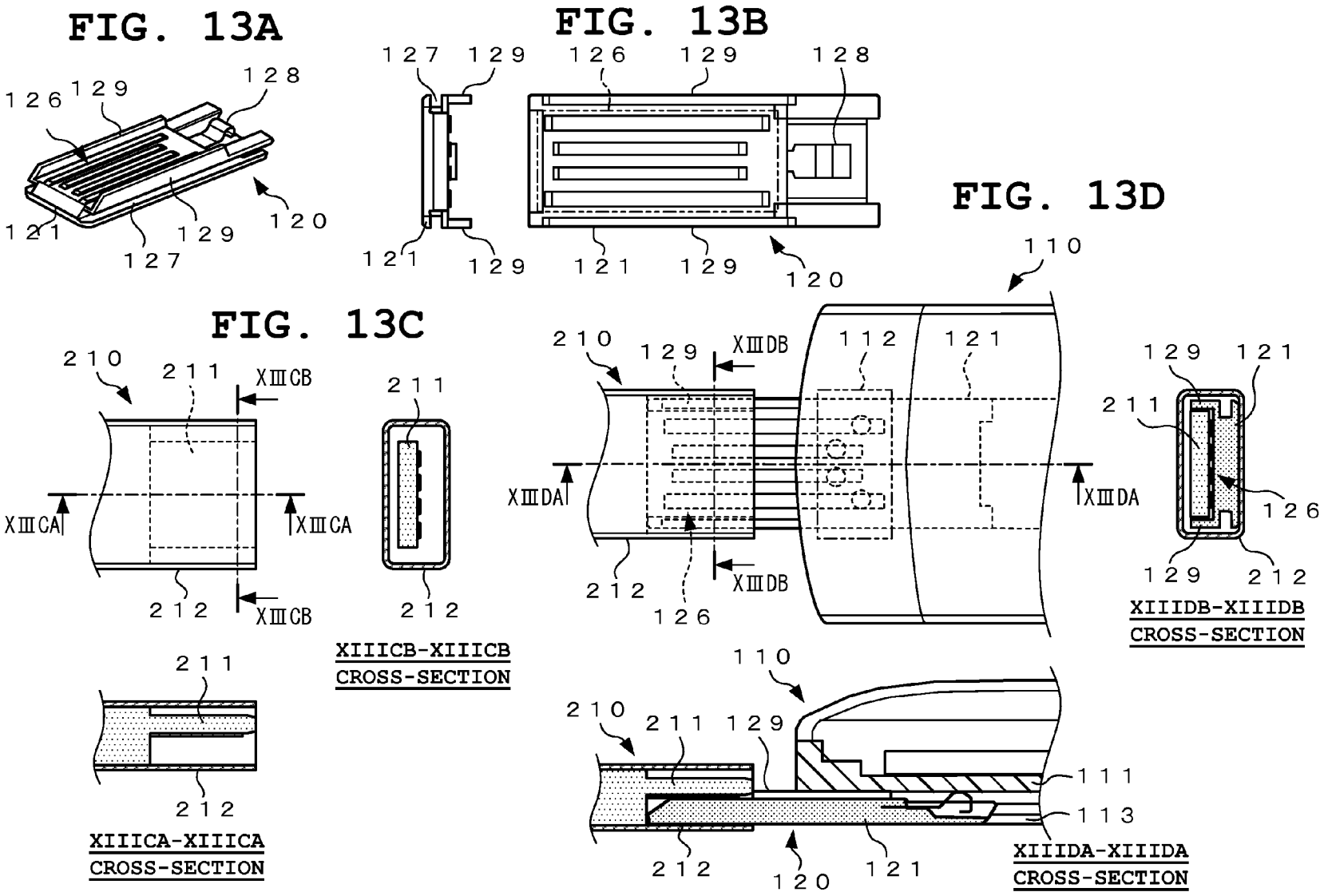
FIG. 13A to FIG. 13D are structural diagrams showing a modification example of the electronic device according to the fourth embodiment.

FIG. 13A is a perspective view showing a connector section of the electronic device, FIG. 13B shows planar and side views of the connector section of the electronic device, and FIG. 13C shows planar and sectional views of one example of a plug inserting section of an external device.

FIG. 13D shows planar and sectional views of a connected state of the connector section and the plug inserting section. Note that descriptions of sections equivalent to those of each embodiment described above are simplified.

In the electronic device according to the modification example of the present embodiment, the device body 110 has a structure equivalent to that of the above-described specific example (refer to FIG. 10A), in which the connection terminals 112 are exposed on the inner surface of the slide groove 113.

The connector section 120 has a structure which is equivalent to that of the above-described specific example (refer to FIG. 10B to FIG. 10D) except that paired reverse-insertion prevention projections (protruding sections) 129 have been provided protruding along the side surfaces of the connector body 121 in the longitudinal direction on one surface side of the connector body 121 where the connection terminals 126 have been arranged, as shown in FIG. 13A and FIG. 13B.

Specifically, the connector section 120 has a shape by which, when the external device has the plug inserting section 210 of USB TYPE-A and the connector section 120 is inserted into the plug inserting section 210, three surfaces including a surface where the connection terminals 126 of the connector body 121 have been arranged and the paired reverse-insertion prevention projections 129 come in contact with a socket substrate 211 in the plug inserting section 210, as shown in FIG. 13C and FIG. 13D.

In the structure shown in FIG. 13A and FIG. 13B, the reverse-insertion prevention projections 129 have been provided to project near the side surfaces of the connector body 121 located in the longitudinal direction.

Here, the shapes, sizes, and positions of the reverse-insertion prevention projections 129 have been set corresponding to the shape and width of the socket substrate 211 in the plug inserting section 210. For example, the length between the paired reverse-insertion prevention projections 129 has been set slightly larger than the width of the socket substrate 211.

In the electronic device 100 structured as described above, the user attaches the connector section 120 to the slide groove 113 of the device body 110 and slides the connector section 120 to the end position in the slide groove 113, as with the above-described embodiments.

As a result, the connection terminals 126 of the connector section 120 protrude from the end portion of the device body 110, and are electrically connected to the internal circuit of the device body 110 via the connection terminals 112 of the device body 110.

Then, the user directly inserts the connector section 120 protruding from the end portion of the device body 110 into the plug inserting section 210 of USB TYPE-A of the external device 200 for connection, as shown in FIG. 13D. Here, because of the surface where the connection terminals 126 of the connector body 121 have been arranged and the reverse-insertion prevention projections 129, the connector section 120 is inserted into the plug inserting section 210 along the socket substrate 211 while surrounding the socket substrate 211 in the plug inserting section 210 from three directions (in an inverted-C cross sectional shape).

That is, when the connector section 120 is inserted in a normal direction, the reverse-insertion prevention projections 129 of the connector section 120 enter a space between the side surfaces of the socket substrate 211 in the plug inserting section 210 and a metal shell 212, whereby the connector section 120 is inserted in a normal orientation, as shown in FIG. 13D.

Conversely, when the user tries to insert the connector section 120 in a direction reverse to the normal direction (with the front and rear surfaces inverted), the reverse-insertion prevention projections 129 of the connector section 120 interfere with the metal shell 212 of the plug inserting section 210, so that the connector section 120 cannot be inserted into the plug inserting section 210.

As a result, the reverse insertion of the connector section 120 can be prevented by the simple structure without a communication cable or the like, whereby the electronic device 100 and the external device 200 can be normally connected to each other, and data transmission and power feeding (charging) can be favorably performed therebetween.

In the present modification example, the reverse-insertion prevention projections 129 are provided near the side surfaces of the connector body 121 and the connector section 120 is inserted into the plug inserting section 210 with the socket substrate 211 in the plug inserting section 210 being surrounded from three directions in an inverted-C cross sectional shape, as shown in FIG. 13D. However, the present embodiment is not limited to this, and may have another structure as long as it can prevent the reverse insertion of the thinned connector section 120.

For example, a structure may be adopted in which the reverse-insertion prevention projection 129 is provided near only one side surface of the connector body 121, and the connector section 120 is inserted into the plug inserting section 210 while surrounding the socket substrate 211 from two directions in a L cross sectional shape.

In the present embodiment, the thinning of the connector section 120 and its reverse insertion prevention mechanism have been applied to the plug of USB TYPE-A. However, they may be applied to other general purpose interface standards. In this case, particularly in the present modification example, the shapes, sizes, and positions of the reverse-insertion prevention projections 129 to be provided to the connector body 121 are set corresponding to a socket substrate in a plug inserting section corresponding to the interface standards to be applied.

Accordingly, since the relation between the plug inserting section 210 and the connector section 120 is specified as a one-to-one relation according to the interface standards, not only the reverse insertion of a connector section of the same interface standards but also the erroneous connection (erroneous insertion) of a connector section of different interface standards can be prevented.

In each of the above-described embodiments, the connector section 120 has been described which has the terminal structure where connection terminals have been arranged on only one surface side of the connector body 121 as a plug shape of general purpose interface standards for wired communication. However, the present invention is not limited thereto, and the connector section 120 may have a terminal structure where connection terminals are arranged on one surface side and the other surface side (that is, both of the front and rear surfaces) of the connector body 121.

Also, in each of the above-described embodiments, the connector section 120 is attached or attached and slid when the electronic device 100 and the external device 200 are connected to each other (in the present embodiment, after sensor data is collected by the electronic device 100). However, the present invention is not limited thereto, and a configuration may be adopted in which sensor data is collected with a connector section of predetermined general purpose interface standards being already attached to the device body 110 (at an initial position and in a state where the plug of the connector section is not protruding from the device body 110).

While the present invention has been described with reference to the preferred embodiments, it is intended that the invention be not limited by any of the details of the description therein but includes all the embodiments which fall within the scope of the appended claims.

What is claimed is:

1. An electronic device comprising:

a device body which has an installation section and an internal circuit; and a connector section which is attachable to the installation section and removable from the installation section, wherein the connector section has two functional sections for connection to an external device which are different from each other, wherein the connector section is attached to the installation section in a first orientation or in a second orientation opposite to the first orientation, and wherein the installation section makes one of the two functional sections usable when the connector section is attached to the installation section in the first orientation, and makes another one of the two functional sections usable when the connector section is attached to the installation section in the second orientation.

2. An electronic device comprising:

a device body which has an installation section and an internal circuit; and a connector section which is attachable to the installation section and removable from the installation section, wherein the connector section has at least one functional section for connection to an external device, wherein the functional section of the connector section has a plug section having a structure corresponding to any one of a plurality of different types of interface standards, and wherein the installation section has a mechanism by which the connector section is attachable to a first position where the plug section is in a storage state of not protruding externally from the device body and a second position where the plug section is in a protruding state of protruding externally from the device body.

3. The electronic device according to claim 2, wherein the plug section has a structure corresponding to any one of USB TYPE-A, USB TYPE-mini B, USB 3.0, RS232C and IEEE 1394.

4. The electronic device according to claim 2, wherein each of a plurality of different types of connector sections is attachable to the installation section by replacement.

5. An electronic device comprising:

a device body which has an installation section and an internal circuit; and a connector section which is attachable to the installation section and removable from the installation section, wherein the connector section has at least one functional section for connection to an external device, wherein the functional section has an antenna element corresponding to any one of a plurality of different types of interface standards for wireless communication, and wherein the connector section is connected to the external device by a wireless communication method in a state of being attached to the installation section.

6. An electronic device comprising:

a device body which has an installation section and an internal circuit; and a connector section which is attachable to the installation section and removable from the installation section, wherein the connector section has at least one functional section for connection to an external device, and is constituted by only one plate-shaped insulating member, wherein the installation section extends has a mechanism by which the plate-shaped member of the attached connector section is attachable to a position where the functional section is in a storage state of not protruding externally from the device body and a position where the functional section is in a protruding state of protruding externally from the device body.

7. The electronic device according to claim 6, wherein the connector section has a projection section provided to the plate-shaped member and set to have a shape and a size by which the connector section cannot be inserted in an orientation that is not a normal orientation when the functional section of the connector section is inserted into the external device.

8. A connector section comprising:

two functional sections for connection to an external device which are different from each other, wherein the connector section has a shape by which the connector section is attachable to and removable from an installation section of a device body comprising the installation section and an internal circuit, the connector section being attachable to the installation section in a first orientation or in a second orientation opposite to the first orientation, and wherein one of the two functional sections is electrically connected to the internal circuit when the connector section is attached to the installation section in the first orientation, and another one of the two functional sections is electrically connected to the internal circuit when the connector section is attached to the installation section in the second orientation.

9. An electronic device comprising:

a device body which has an installation section and an internal circuit, wherein a connector section, which has two functional sections for connection to an external device which are different from each other, is attachable to the installation section and removable from the installation section, and the connector section is attachable to the installation section in a first orientation or in a second orientation opposite to the first orientation, and wherein the installation section makes one of the two functional sections usable when the connector section is attached to the installation section in the first orientation, and makes another one of the two functional sections usable when the connector section is attached to the installation section in the second orientation.

* * * * *